US005229236A

United States Patent [19]

Kato et al.

[11] Patent Number: 5,229,236

[45] Date of Patent: Jul. 20, 1993

[54] ELECTROPHOTOGRAPHIC LITHOGRAPHIC PRINTING PLATE PRECURSOR

[75] Inventors: Eiichi Kato; Kazuo Ishii; Seishi Kasai; Hirohisa Yamasaki, all of Shizuoka, Japan

[73] Assignee: Fuji Photo Film Co., Ltd., Kanagawa, Japan

[21] Appl. No.: 725,091

[22] Filed: Jul. 3, 1991

[30] Foreign Application Priority Data

Jul. 6, 1990 [JP] Japan ..... 2-177449
Aug. 28, 1990 [JP] Japan ..... 2-224190

[51] Int. Cl.[5] ..... G03G 13/26

[52] U.S. Cl. ..... 430/49; 430/87; 430/96

[58] Field of Search ..... 430/96, 49, 87

[56] References Cited

U.S. PATENT DOCUMENTS 5,053,301 10/1991 Kato et al. ..... 430/49

*Primary Examiner*—Marion E. McCamish
*Assistant Examiner*—Rosemary Ashton
*Attorney, Agent, or Firm*—Sughrue, Mion, Zinn, Macpeak & Seas

[57] ABSTRACT

An electrophotographic lithographic printing plate precursor having a conductive support having provided thereon at least one photoconductive layer containing photoconductive zinc oxide and a binder resin, wherein the photoconductive layer contains at least one of the following non-aqueous solvent-dispersed resin grains having an average grain diameter of same as or smaller than the maximum grain diameter of the photoconductive zinc oxide grains: wherein the non-aqueous solvent-dispersed resin grains comprise copolymer resin grains obtained by (i) subjecting to a polymerization reaction in a non-aqueous solvent, a monofunctional monomer (A) being soluble in the non-aqueous solvent but insoluble after polymerization and containing at least one polar group, as described herein, and a monofunctional polymer [M] comprising a polymer principal chain containing at least recurring units each containing a silicon atom and/or fluorine atom-containing substituent, to only one end of which a polymerizable double bond group represented by the following general formula (I), as described herein, is bonded; or (2) subjecting to a dispersion polymerization reaction in a non-aqueous solvent in the presence of a dispersion stabilizing resin soluble in the non-aqueous solvent, a monofunctional monomer (A) being soluble in the non-aqueous solvent but insoluble after polymerization and containing at least one polar group, as described herein, and a monofunctional monomer [B] being copolymerizable with the monofunctional monomer (A) and having a silicon atom and/or fluorine atom-containing substituent.

19 Claims, No Drawings

ELECTROPHOTOGRAPHIC LITHOGRAPHIC PRINTING PLATE PRECURSOR

BACKGROUND OF THE INVENTION

1. Field of the Invention

This invention relates to an electrophotographic lithographic printing plate precursor made by an electrophotographic system and more particularly, it is concerned with an improvement in a photoconductive layer forming composition for the lithographic printing plate precursor.

2. Description of the Prior Art

A number of offset masters for directly producing printing plates have hitherto been proposed and some of them have already been put into practical use. Widely employed among them is a system in which a photoreceptor comprising a conductive support having provided thereon a photoconductive layer mainly comprising photoconductive particles, for example, of zinc oxide and a binder resin is subjected to an ordinary electrophotographic processing to form a highly lithographic toner image on the surface of the photoreceptor, followed by treating the surface with an oil desensitizing solution referred to as an etching solution to selectively render non-image areas hydrophilic and thus obtain an offset printing plate.

Requirements of offset masters for obtaining satisfactory prints include: (1) an original should be reproduced faithfully on the photoreceptor; (2) the surface of the photoreceptor has affinity with an oil-desensitizing solution so as to render non-image areas sufficiently hydrophilic, but, at the same time, has resistance to solubilization; and (3) a photoconductive layer having an image formed thereon is not released during printing and is well receptive to dampening water so that the non-image areas retain the hydrophilic properties to be free from stains even upon printing a large number of prints.

It is known that these properties are affected by the ratio of zinc oxide to a resin binder in the photoconductive layer, For example, if the ratio of a binder resin to zinc oxide particles is decreased, oil-desensitivity of the surface of the photoconductive layer is increased to reduce background stains, but, on the other hand, the internal cohesion of the photoconductive layer per se is weakened, resulting in reduction of printing durability due to insufficient mechanical strength. If the ratio of a binder resin to zinc oxide particles is increased, on the other hand, printing durability is improved, but background staining becomes conspicuous. It is a matter of course that the background staining is a phenomenon associated with the degree of oil-desensitization achieved and it has been made apparent that the oil-desensitization of the photoconductive layer surface depends on not only the binder resin/zinc oxide ratio in the photoconductive layer, but also the kind of the binder resin used to a great extent.

For particular use as an offset master, occurrence of background stains due to insufficient oil-desensitivity presents a serious problem. In order to solve this problem, various resins for binding zinc oxide have been proposed, including resins having a weight average molecular weight Mw $1.8\text{-}10\times10^{-4}$ and a glass transition point Tg 10°-80° C., obtained by copolymerizing (meth)acrylate monomers and other monomers in the presence of fumaric acid in combination with copolymers of (meth)acrylate monomers and other monomers than fumaric acid, as described in Japanese Patent Publication No. 31011/1975; terpolymers each containing a (meth)acrylic acid ester unit having a substituent having carboxylic acid group at least 7 atoms distant from the ester linkage, as disclosed in Japanese Patent Laid-Open Publication No. 54027/1978; tetra- or pentamers each containing an acrylic acid unit and hydroxyethyl unit, as disclosed in Japanese Patent Laid-Open Publication Nos. 20735/1979 and 202544/1982; terpolymers each containing a (meth)acrylic acid ester unit having an alkyl group having 6 to 12 carbon atoms as a substituent and a vinyl monomer containing carboxylic acid group, as disclosed in Japanese Patent Laid-Open Publication No. 68046/1983; and the like. These resins function to improve the oil-desensitivity of photoconductive layers. Nevertheless, evaluation of such resins as noted above for improving the oil-desensitization indicates that none of them is completely satisfactory in in terms of stain resistance, printing durability and the like.

Furthermore, Japanese Patent Laid-Open Publication Nos. 232356/1989 and 261657/1989 describe that addition of resin grains containing hydrophilic groups to the photoconductive layer is effective for improving the water retention.

It has been confirmed that the water retention is largely increased by improving these photoconductive compositions. However, detailed estimation thereof as a lithographic printing plate precursor tells that in some cases, the electrophotographic properties, in particular, dark charge retention, photosensitivity, etc. are changed or deteriorated when the ambient conditions are changed in a high temperature and high humidity or in a low temperature and low humidity, and a stable and good reproduced image cannot thus be obtained. Consequently, the use of these photoconductive compositions for a printing plate precursor results in deterioration of a print image and decrease of the effect of preventing background stains.

When using the scanning exposing system using a semiconductor laser beam for an electrophotographic lithographic printing plate precursor as a digital direct lithographic printing plate precursor, furthermore, higher performances are required for static properties, in particular, dark charge retention and photosensitivity, since the exposing time is longer and the exposing intensity is more restricted than in the overall and simultaneously exposing system of the prior art using visible rays.

On the contrary, in the above described precursor of the prior art, the electrophotographic properties are deteriorated and real copy images tend to meet with occurrence of background stains and disappearance of fine lines or batterig of letters, so that when printing is carried out using it as a lithographic printing plate precursor, the image quality of a print is lowered and there is not found the effect of preventing background stains by improvement of the hydrophilic property of non-image areas of a binder resin. The present invention aims at solving the above described problems of the electrophotographic lithographic printing plate precursor of the prior art.

SUMMARY OF THE INVENTION

It is an object of the present invention to provide an electrophotographic lithographic printing plate precursor, whereby the disadvantages of the prior art, as described above, can be overcome.

It is another object of the present invention to provide a lithographic printing plate precursor excellent in oil-desensitivity as well as static properties, in particular, dark charge retention and photosensitivity, whereby an original is faithfully reproduced without occurrence of overall or spotted stains as an offset master.

It is a further object of the present invention to provide a lithographic printing plate with a clear and good quality image even if the ambient conditions during forming a reproduced image are fluctuated from low temperature and low humidity to high temperature and high humidity.

It is a still further object of the present invention to provide a lithographic printing precursor which is hardly affected by the kind of sensitizing dyes and which is capable of exhibiting excellent static properties even in the scanning exposing system using a semiconductor laser beam.

These objects can be attained by an electrophotographic lithographic printing plate precursor comprising a conductive support having provided thereon at least one photoconductive layer containing photoconductive zinc oxide and a binder resin, wherein the photoconductive layer contains at least one of the following non-aqueous solvent-dispersed resin grains having an average grain diameter of same as or smaller than the maximum grain diameter of the photoconductive zinc oxide grains:

Non-Aqueous Solvent-Dispersed Resin Grains

Copolymer resin grains obtained by (1) subjecting to polymerization reaction in a non-aqueous solvent, a monofunctional monomer (A) being soluble in the non-aqueous solvent but insoluble after polymerization and containing at least one polar group selected from the group consisting of carboxyl group, sulfo group, sulfino group, phosphono group,

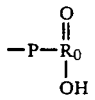

[wherein $R_0$ is a hydrocarbon group or $—OR_{10}$ wherein $R_{10}$ is a hydrocarbon group], hydroxyl group, formyl group, amide group, cyano group, amino group, a cyclic acid anhydride-containing group and a nitrogen atom-containing heterocyclic group, and a monofunctional polymer [M] comprising a polymer principal chain containing at least recurring units each containing a silicon atom and/or fluorine atom-containing substituent, to only one end of which a polymerizable double bond group represented by the following general formula (I) is bonded:

General Formula (I)

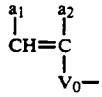

wherein $V_0$ is —O—, —COO—, —OCO—, $—CH_2OCO—$, $—CH_2COO—$, $—SO_2—$, $—CON(R_1)—$, $—SO_2N(R_1)—$, -continued General Formula (I)

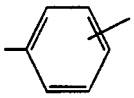

, —CONHCOO— or —CONHCONH—

($R_1$ is a hydrogen atom or a hydrocarbon group containing 1 to 18 carbon atoms), and $a_1$ and $a_2$ are, same or different, hydrogen atoms, halogen atoms, cyano groups, hydrocarbon groups, $—COO—R_2$ or $—COO—R_2—$ via a hydrocarbon group ($R_2$ is a hydrogen atom or optionally substituted hydrocarbon group), or (2) subjecting to dispersion polymerization reaction in a non-aqueous solvent, the above described monofunctional monomer (A) and a monofunctional monomer (B) being copolymerizable with the monofunctional monomer (A) and containing a silicon atom and/or fluorine atom-containing substituent in the presence of a dispersion-stabilizing resin soluble in the non-aqueous solvent.

In the present invention, the above described dispersed resin grains can form a network structure of high order.

DETAILED DESCRIPTION OF THE INVENTION

One feature of the present invention consists in that the non-aqueous solvent-dispersed resin grains (which will hereinafter be referred to as "resin grains" sometimes) are obtained by chemically bonding a polymeric component containing at least one of the above described specified polar groups and being insoluble in the non-aqueous solvent after the polymerization and a polymeric component containing at least recurring units containing a silicon atom and/or fluorine atom-containing substituent and being soluble in the non-aqueous solvent after the polymerization. This invention will sometimes be referred to as the first invention.

Another feature of the present invention consists in that the non-aqueous solvent-dispersed resin grains (which will hereinafter be referred to as "resin grains" sometimes) are obtained by physical and chemical adsorption of a polymeric component being insoluble in the non-aqueous solvent after polymerization from a monomer containing at least one of the above described specified polar groups and a monomer containing at least one of fluorine atom and silicon atom as a substituent, and a polymeric component of a dispersion-stabilizing resin soluble in the non-aqueous solvent, or by chemically bonding both the polymeric components when the dispersion stabilizing resin contains the double bond groups represented by the following general formula (II) will sometimes be referred to as the second invention.

In the second invention, the dispersion-stabilizing resin is preferably one containing at least one polymerizable double bond group moiety represented by the following general formula (II) in the polymer chain:

General Formula (II)

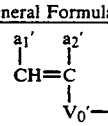

wherein $V_0'$ is —O—, —COO—, —OCO—, $—(CH_2)_p—OCO—$,

-continued

General Formula (II)

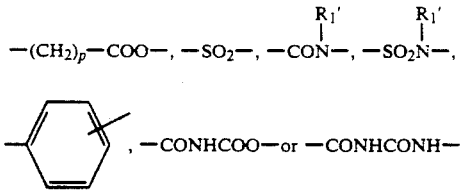

(p is an integer of 1 to 4 and $R_1'$ is a hydrogen atom or a hydrocarbon group containing 1 to 18 carbon atoms), and $a_1'$ and $a_2'$ are, same or different, hydrogen atoms, halogen atoms, cyano groups, hydrocarbon groups, —COO—$R_2'$— or —COO—$R_2'$ via a hydrocarbon group ($R_2'$ is a hydrogen atom or optionally substituted hydrocarbon group).

In the prior art, hydrophilic resin grains are dispersed in a photoconductive layer, while in the present invention, the non-aqueous solvent-dispersed resin grains are dispersed in a photoconductive layer, but have the feature that the resin grains are present to be concentrated near the surface area of the photoconductive layer, as an air boundary (having high lipophilic property), by the aid of the polymeric component containing fluorine atoms and/or silicon atoms having remarkably large lipophilic property and the average grain diameter thereof is same as or smaller than the maximum grain diameter of photoconductive zinc oxide grains, the distribution of the grain diameter thereof being narrower and more uniform.

The resin grains of the present invention have the above described average grain diameter and the film formed by dissolving the resin grains in a suitable solvent and then coating is so hydrophilic that it has a contact angle with distilled water of 50 degrees or less, preferably 30 degrees or less, measured by a onigometer.

In a printing plate precursor of such a system that a non-image area of a photoconductive layer containing at least photoconductive zinc oxide and a binder resin is processed with an oil-desensitizing solution and the surface is thus rendered hydrophilic to give a lithographic printing plate precursor, the resin grains of the present invention are present to be concentrated near the surface area as described above and accordingly, the water retention of the non-image area can markedly be improved by dispersing a smaller amount of the resin grains (i.e. 50 to 10% of the amount of the prior art hydrophilic resin grains). Furthermore, since the amount of the resin grains can largely be decreased in the photoconductive layer, good performances can stably be maintained as the printing plate precursor even under severer conditions, high temperature and high humidity or low temperature and low humidity without deteriorating the electrophotographic properties.

On the other hand, if there are resin grains having larger grain diameters than zinc oxide grains, the electrophotographic properties are deteriorated and in particular, uniform electrification cannot be obtained, thus resulting in density unevenness in an image, disappearance of letters or fine lines and background staining in a non-image area in a reproduced image.

Specifically, the resin grains of the present invention have a maximum grain diameter of at most 5 μm, preferably at most 1 μm and an average grain diameter of at most 1.0 μm, preferably 0.5 μm. The specific surface areas of the resin grains are increased with the decrease of the grain diameter, resulting in good electrophotographic properties, and the grain size of colloidal grains, i.e. about 0.01 μm or less is sufficient, but very small grains cause to decrease the effect of improving the water retention as in the case of molecular dispersion. Accordingly, a grain size of at least 0.001 μm is preferable.

In the present invention, the resin grains contain a hydrophobic polymeric component bonded, which is capable of exhibiting an anchor effect through interaction of the hydrophobic part with the binder resin in the photoconductive layer, thus preventing from dissolving out with dampening water during printing and maintaining good printing properties even after a considerable number of prints are obtained.

When a high order network structure is formed in the resin grain of the present invention, moreover, the dissolving-out with water is suppressed and on the other hand, water-swelling property appears to improve the water retention capacity.

In the present invention, the resin grains having no such a high order network structure or the resin grains having a high order network structure (which will hereinafter be referred to as "network resin grains") are preferably used in a proportion of 0.01 to 5% by weight based on 100 parts by weight of the photoconductive zinc oxide, since if the amount of resin grains or the network resin grains is less than 0.01% by weight, the hydrophilic property of a non-image area does not sufficient, while if more than 5% by weight, the hydrophilic property of a non-image area is further improved, but electrophotographic properties and reproduced images are deteriorated.

The non-aqueous solvent-dispersed resin grains used in the present invention will now be illustrated in greater detail. The resin grains of the present invention are prepared by the so-called non-aqueous dispersion polymerization.

The monofunctional monomer (A), being soluble in a non-aqueous solvent, but insoluble after the polymerization, will be illustrated. The monomer (A) contains, in the molecular structure, at least one polar group selected from the group consisting of

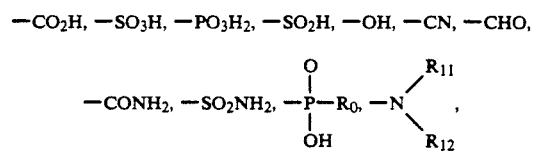

cyclic acid anhydride-containing groups and nitrogen-containing heterocyclic groups.

In the above described polar groups, —$R_0$ is an optionally substituted hydrocarbon group containing 1 to fi carbon atoms, such as methyl, ethyl, propyl, butyl, 2-chloroethyl, 2-bromoethyl, 2-fluoroethyl, 3-chloropropyl, 3-methoxypropyl, 2-methoxybutyl, benzyl, phenyl, propenyl, methoxymethyl, ethoxymethyl, 2-methoxyethyl and the like; or —$OR_{10}$ wherein $R_{10}$ has the same meaning as $R_0$.

$R_{11}$ and $R_{12}$ are, same or different, hydrogen atoms or optionally substituted hydrocarbon groups containing 1 to 6 carbon atoms (e.g., including the same hydrocarbon groups as $R_0$), the sum of carbon atoms in $R_{11}$ and $R_{12}$ being preferably at most 8, more preferably at most 4.

The cyclic acid anhydride-containing group means a group containing at least one cyclic acid anhydride, illustrative of which are aliphatic dicarboxylic acid anhydrides and aromatic dicarboxylic acid anhydrides.

Examples of the aliphatic dicarboxylic acid anhydride include rings of succinic anhydride, glutaconic anhydride, maleic anhydride, cyclopentane-1,2-dicarboxylic anhydride, cyclohexane-1,2-dicarboxylic anhydride, cyclohexene-1,2-dicarboxylic anhydride and 2,3-bicyclo[2,2,2]octanedicarboxylic anhydride. These rings can be substituted, for example, by halogen atoms such as chlorine and bromine atoms and/or alkyl groups such as methyl, ethyl, butyl and hexyl groups.

Examples of the aromatic dicarboxylic acid anhydride include rings of phthalic anhydride, naphthalene dicarboxylic anhydride, pyridine dicarboxylic anhydride and thiophene dicarboxylic anhydride. These rings can be substituted by for example, halogen atoms such as chlorine and bromine atoms, alkyl groups such methyl, ethyl, propyl and butyl groups, hydroxyl group, cyano group, nitro group, alkoxycarbonyl groups wherein the alkoxy groups are methoxy and ethoxy groups, and the like.

As the above described heterocyclic ring containing at least one nitrogen atom, there are 4- to 6-membered heterocyclic rings, for example, rings of pyridine, piperidine, pyrrole, imidazole, pyrazine, pyrrolidine, pyrroline, imidazoline, pyrazolidine, piperazine, morpholine, pyrrolidone and the like. These rings can be substituted by substituents, illustrative of which are halogen atoms such as fluorine, chlorine and bromine atoms; optionally substituted hydrocarbon groups containing 1 to 8 carbon atoms, such as methyl, ethyl, propyl, butyl, 2-chloroethyl, 2-bromoethyl, 2-hydroxyethyl, 2-cyanoethyl, 2-methoxyethyl, 2-ethoxyethyl, 2-butoxyethyl, 2-carboxyethyl, carboxymethyl, 3-sulfopropyl, 4-sulfobutyl, 2-methoxycarbonylethyl, 2-ethoxycarbonylethyl, 2-methanesulfonylethyl, benzyl, carboxybenzyl, carboxymethylbenzyl, phenyl, carboxyphenyl, sulfophenyl, methanesulfonylphenyl, ethanesulfonylphenyl, carboxymethylphenyl, methoxyphenyl, chlorophenyl groups and the like; $-OR_{13}$ wherein $R_{13}$ is an optionally substituted hydrocarbon group containing 1 to 8 carbon atoms, having the same contents as described above, or $-COOR_{14}$ group wherein $R_{14}$ has the same meaning as $R_{13}$.

Each of the above described groups, —COOH, $-SO_2H$, $-PO_3H$, $-PO_3H_2$ and

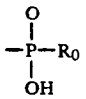

can form a salt with an alkali metal such as lithium, sodium or potassium, alkaline earth metal such as calcium or magnesium or other metals such as zinc and aluminum, or an organic base such as triethylamine, pyridine, morpholine or piperazine.

The monomer (A) composing the principal component of the resin grains of the present invention can be any one containing at least one of the above described polar groups and a polymerizable double bond group in one molecule.

Specifically, examples of the monomer (A) are represented by the following general formula (III):

General Formula (III):

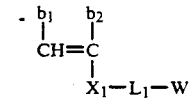

wherein $X_1$ is a direct bond or —COO—, —OCO—, —O—,

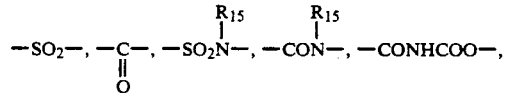

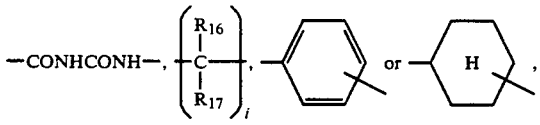

wherein $R_{15}$ represents hydrogen atom or optionally substituted hydrocarbon groups containing 1 to 7 carbon atoms such as methyl, ethyl, propyl, butyl, 2-chloroethyl, 2-hydroxyethyl, 3-bromo-2-hydroxypropyl, 2-carboxyethyl, 3-carboxypropyl, 4-carboxybutyl, 3-sulfopropyl, benzyl, sulfobenzyl, methoxybenzyl, carboxybenzyl, phenyl, sulfophenyl, carboxyphenyl, hydroxyphenyl, 2-methoxyethyl, 3-methoxypropyl, 2-methanesulfonylethyl, 2-cyanoethyl, N,N-(dichloroethyl)aminobenzyl, N,N-(dihydroxyethyl)aminobenzyl, chlorobenzyl, methylbenzyl, N,N-(dihydroxyethyl) aminophenyl, methanesulfonylphenyl, cyanophenyl, dicyanophenyl, acetylphenyl groups and the like, $R_{16}$ and $R_{17}$ each represent, same or different, hydrogen atom, halogen atoms such as fluorine, chlorine, and bromine atoms and aliphatic groups containing 1 to 4 carbon atoms, in particular, alkyl groups such as methyl, ethyl, propyl and butyl groups, and i represents an integer of 1 to 6.

W is the foregoing polar group of the monomer (A).

$L_1$ is a linking group selected from the group consisting of

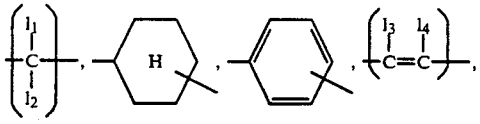

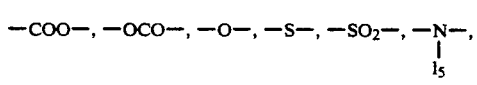

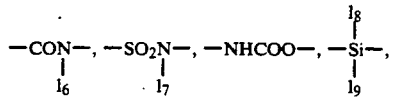

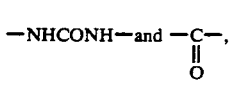

or a bonding group formed by combination of these linking groups, wherein $l_1$ to $l_4$ represent, same or different, hydrogen atom, halogen atoms such as fluorine, chlorine and bromine atoms, hydrocarbon groups containing 1 to 7 carbon atoms which can be substituted, such as methyl, ethyl, propyl, butyl, 2-chloroethyl, 2-methoxyethyl, 2-methoxycarbonylethyl, benzyl, methoxybenzyl, phenyl, methoxyphenyl, methoxycarbonylphenyl groups and the like and -($L_1$-W) groups in the general formula (II), and $l_5$ to $l_9$ have the same meaning as $R_{15}$.

In the general formula (V), $b_1$ and $b_2$ represent, same or different, hydrogen atom, halogen atoms such as fluorine, chlorine and bromine atoms, —COOH, —$COOR_{18}$ and —$CH_2COOR_{18}$ wherein $R_{18}$ represents a hydrocarbon group containing 1 to 7 carbon atoms, in particular, the same hydrocarbon groups as in $R_{15}$, and alkyl groups containing 1 to 4 carbon atoms, such as methyl, ethyl, propyl and butyl groups.

Examples of the above described monomer (A) are given below without limiting the scope of the present invention:

(a-1)

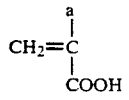

a: —H, —$CH_3$, —Cl, —$CH_2COOH$, —$CH_2COOCH_3$ (a-2)

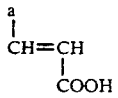

a: —$CH_3$, —COOH, —$CONH_2$, —$CONHC_2H_5$, —$COOCH_3$ (a-3)

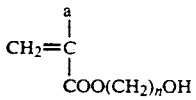

a: —$CH_3$, —H
n: integer of 1~12

(a-4)

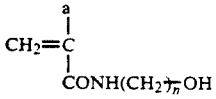

a: —H, —$CH_3$, —Cl
n: integer of 1~12

(a-5)

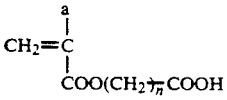

a: —H, —$CH_3$, —$CH_2COOH$, —$CH_2COOCH_3$
n: integer of 1~12

(a-6)

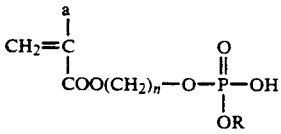

a: —H, —$CH_3$
n: integer of 1~12
R: —H, —$CH_3$, —$C_2H_5$ (a-7)

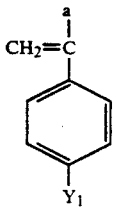

-continued a: —H, —$CH_3$
$Y_1$: —$SO_3H$, —COOH, —$CH_2OH$,

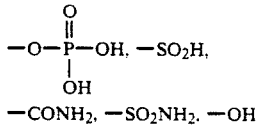

—$CONH_2$, —$SO_2NH_2$, —OH (a-8)

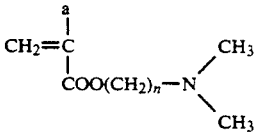

a: —H, —$CH_3$
n: integer of 1~4

(a-9)

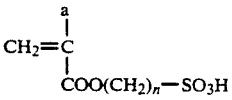

a: —H, —$CH_3$
n: integer of 2~12

(a-10)

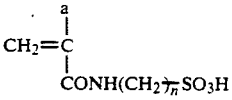

a: —H, —$CH_3$
n: integer of 2~12

(a-11)

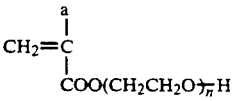

a: —H, —$CH_3$
n: integer of 1~4

(a-12)

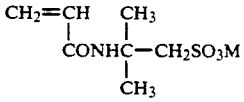

M: Li, Na, K, $HN(C_2H_5)_3$, H—N 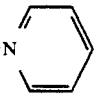

(a-13)

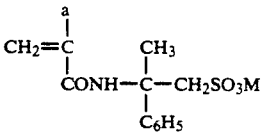

a: —H, —$CH_3$
M: Li, Na, K, $HN(C_2H_5)_3$, H—N 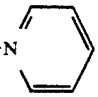

(a-14)

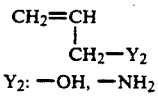

$Y_2$: —OH, —$NH_2$ (a-15)

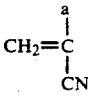

a: —H, —$CH_3$

-continued
(a-16)
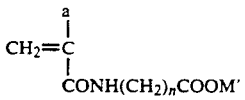
a: —H, —$CH_3$
n: integer of 1 ~ 11
M': Li, Na, K, H—$N(C_2H_5)_3$
(a-17)
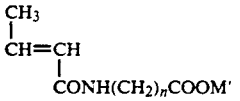
n: integer of 1 ~ 11
M': Li, Na, K, H—$N(C_2H_5)_3$
(a-18)
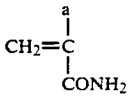
a: —H, —$CH_3$
(a-19)
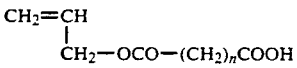
n: integer of 1 ~ 4
(a-20)
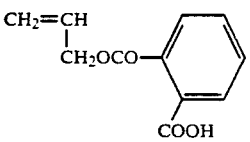
(a-21)
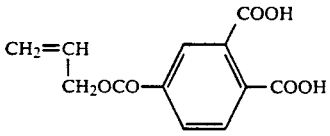
(a-22)
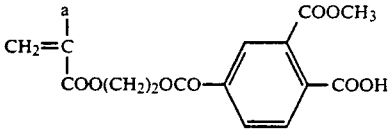
a: —H, —$CH_3$
(a-23)
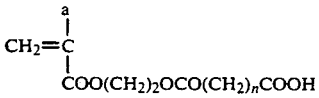
a: —H, —$CH_3$
n: integer of 1 ~ 10
(a-24)
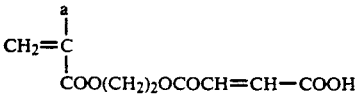
a: —H, —$CH_3$, —$CH_2COOCH_3$
(a-25)
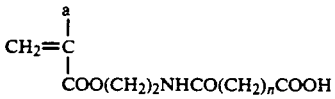
a: —H, —$CH_3$
n: integer of 1 ~ 10
(a-26)
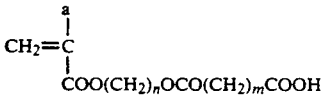
a: —H, —$CH_3$, —$CH_2COOCH_3$
n: integer of 2 ~ 10
m: integer of 1 ~ 10
[(n + m) = 10 or less]
(a-27)
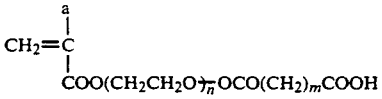
a: —H, —$CH_3$, —Cl
n: integer of 1 ~ 4
m: integer of 1 ~ 4
(a-28)
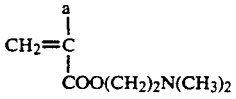
a: —H, —$CH_3$
(a-29)
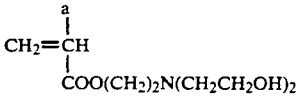
a: —H, —$CH_3$
(a-30)
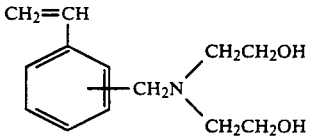
(a-31)
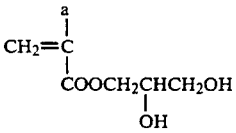
a: —H, —$CH_3$
(a-32)
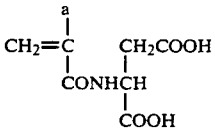
a: —H, —$CH_3$
(a-33)
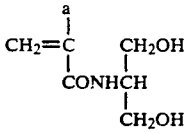
a: —H, —$CH_3$
(a-34)
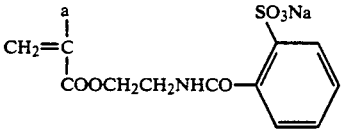
a: —H, —$CH_3$
(a-35)
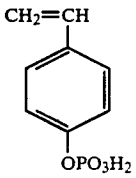

-continued (a-36)

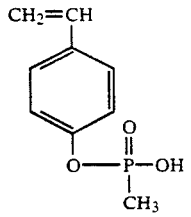

(a-37)

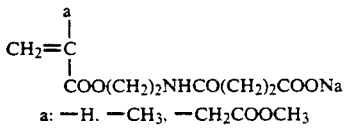

a: —H, —$CH_3$, —$CH_2COOCH_3$ (a-38)

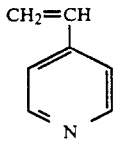

(a-39)

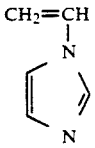

(a-40)

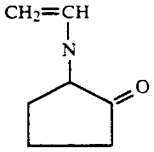

(a-41)

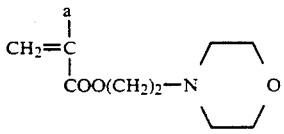

a: —H, —$CH_3$ (a-42)

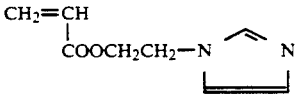

(a-43)

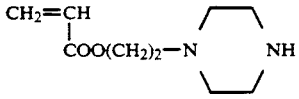

(a-44)

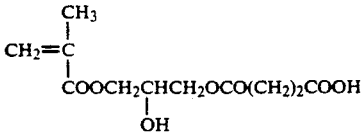

(a-45)

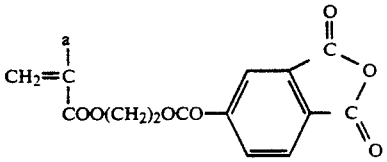

-continued (a-46)

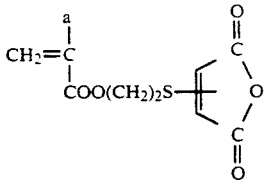

(a-47)

$CH_2=CH-CH_2OCO(CH_2)_n COOH$ n: integer of 1 to 3

(a-48)

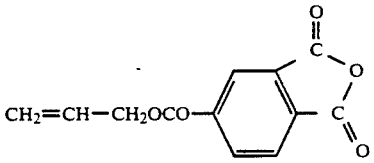

In addition to the above described polar group-containing monomer (A), other monomers to be copolymerized can be contained as a polymeric component. Examples of the other monomers are α-olefins, vinyl or allyl alkanates, acrylonitrile, methacrylonitrile, vinyl ether, acrylamide, methacrylamide, styrenes and heterocyclic vinyl compounds, for example, 5- to 7-membered heterocyclic compounds containing 1 to 3 nonmetallic atoms other than nitrogen atoms, such as oxygen atom and sulfur atom, illustrative of which are vinylthiophene, vinyldioxane, vinylfuran and the like. Examples of these compounds are vinyl or allyl esters of alkanic acids containing 1 to 3 carbon atoms, acrylonitrile, methacrylonitrile, styrene or styrene derivatives such as vinyltoluene, butylstyrene, methoxystyrene, chlorostyrene, dichlorostyrene, bromostyrene, ethoxystyrene, etc. and the like. The present invention is not intended to be limited thereto.

As a polymeric component in the resin, the monomer (A) is generally present in a proportion of at least 30% by weight, preferably at least 50% by weight and more preferably, the resin is composed of only the monomer (A) and the monofunctional polymer [M].

The monofunctional polymer [M] of the present first invention will now be illustrated. It is important that the polymer characterized by containing at least recurring units containing a substituent containing silicon atom and/or fluorine atom and by having a polymerizable double bond group represented by the general formula (I) bonded to only one end of the polymer principal chain is copolymerized with the monomer (A) and is subject to solvation and soluble in the non-aqueous solvent. That is, the polymer functions as a dispersion-stabilizing resin in the so-called non-aqueous dispersion polymerization.

The monofunctional polymer [M] of the present invention should be soluble in the non-aqueous solvent, specifically to such an extent that at least 5% by weight of the polymer is dissolved in 100 parts by weight of the solvent at 25° C.

The weight average molecular weight of the polymer [M] is generally in the range of $1\times10^3$ to $1\times10^5$, preferably $2\times10^3$ to $5\times10^4$, more preferably $3\times10^3$ to $2\times10^4$. If the weight average molecular weight of the polymer [M] is less than $1\times10^3$, the resulting dispersed resin grains tend to aggregate, so that fine grains whose average grain diameters are uniform can hardly be obtained, while if more than $1\times10^5$, the advantage of the present invention will rather be decreased that the addition thereof to a photoconductive layer results in improving the water retention while satisfying the electrophotographic property.

The polymerizable double bond group component represented by the general formula (I), bonded to only one end of the polymer main chain in the monofunctional polymer [M], will be illustrated in the following:

General Formula (I)

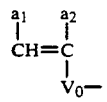

wherein $V_0$ is —O—, —COO—, —OCO—, —$CH_2OCO$—,

—$CH_2COO$—, —$SO_2$—, —$CON(R_1)$—, —$SO_2N(R_1)$—,

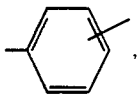

, —CONHCOO— or —CONHCONH—

Herein, $R_1$ represents a hydrogen atom, or preferably an optionally substituted alkyl group containing 1 to 18 carbon atoms such as methyl, ethyl, propyl, butyl, heptyl, hexyl, octyl, decyl, dodecyl, hexadecyl, octadecyl, 2-chloroethyl, 2-bromoethyl, 2-cycanoethyl, 2-methoxycarbonylethyl, 2-methoxyethyl, 3-bromopropyl groups and the like; an optionally substituted alkenyl group containing 4 to 18 carbon atoms such as 2-methyl-1-propenyl, 2-butenyl, 2-pentenyl, 3-methyl-2-pentenyl, 1-pentenyl, 1-hexenyl, 2-hexenyl, 4-methyl-2-hexenyl groups and the like; an optionally substituted aralkyl group containing 7 to 12 carbon atoms such as benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl groups and the like; an optionally substituted alicyclic group containing 5 to 8 carbon atoms such as cyclohexyl, 2-cyclohexylethyl, 2-cyclopentylethyl groups and like; and an optionally substituted aromatic group containing 6 to 12 carbon atoms such as phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cycanophenyl, acetylphenyl, methoxycarbonylphenyl, ethoxycarbonylphenyl, butoxycarbonylphenyl, acetamidophenyl, propioamidophenyl, dodecyloylamidophenyl groups and the like.

When $V_0$ represents

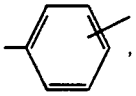

the benzene ring can have a substituent. As the substituent, there can be used halogen atoms such as chlorine, bromine atoms, etc.; alkyl groups such as methyl, ethyl, propyl, butyl, chloromethyl, methoxymethyl groups, etc.; and alkoxy groups such as methoxy, ethoxy, propioxy, butoxy groups.

$a_1$ and $a_2$ represent preferably, same or different, hydrogen atoms, halogen atoms such as chlorine, bromine atoms, etc.; cyano group; alkyl groups containing 1 to 4 carbon atoms such as methyl, ethyl, propyl, butyl groups, etc.; and —COO—$R_2$ or —COO—$R_2$ via a hydrocarbon group, wherein $R_2$ is a hydrogen atom, an alkyl group containing 1 to 18 carbon atoms, an alkenyl group, an aralkyl group, an alicyclic group or an aryl group, which can be substituted and specifically, which has the same meaning as $R_1$.

The hydrocarbon group in the above described "—COO—$R_2$ via a hydrocarbon group" includes methylene, ethylene, propylene groups, etc.

In the general formula (1), more preferably, $Y_0$ represents —COO, —OCO—, —$CH_2OCO$—, —$CH_2COO$—, —O—, —CONH—, —$SO_2NH$— or

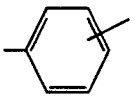

and $a_1$ and $a_2$ represent, same or different, hydrogen atoms, methyl group; —$COOR_2$ or —$CH_2COOR_2$ wherein $R_2$ is a hydrogen atom or an alkyl group containing 1 to 6 carbon atoms such as methyl, ethyl, propyl, butyl, hexyl groups, etc. Most preferably, either of $a_1$ and $a_2$ is surely a hydrogen atom.

Examples of the polymerizable double bond group represented by the general formula (I) are as follows:

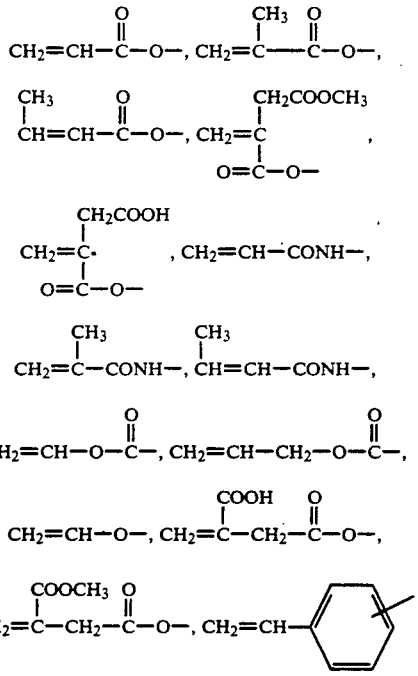

In the present first invention, the recurring unit containing a substituent containing at least one of fluorine atom and silicon atom in the monofunctional polymer [M] will be illustrated.

The recurring units of the polymer can be of any chemical structure obtained from a radical addition-polymerizable monomer or composed of a polyester a polyether, to the side chain of which a fluorine atom and/or silicon atom is bonded.

Examples of the fluorine atom-containing substituent are $-C_hF_{2h+1}$ (h is an integer of 1 to 12), $-(CF_2)_jCF_2H$ (j is an integer of 1 to 11),

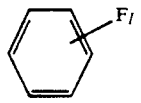

(l is an integer of 1 to 6) and the like.

Examples of the silicon atom-containing substituent are

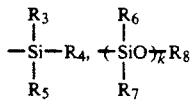

(k is an integer of 1 to 20), polysiloxane structures and the like.

In the above described substituents, $R_3$, $R_4$, and $R_5$ represent, same or different, optionally substituted hydrocarbon groups or $-OR_9$ group wherein $R_9$ has the same meaning as the hydrocarbon group of $R_3$.

$R_3$ is an optionally substituted alkyl group containing 1 to 18 carbon atoms such as methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, 2,2,2,2',2',2'-hexafluoropropyl groups, etc.; an optionally substituted alkenyl group containing 4 to 18 carbon atoms such as 2-methyl-1-propenyl, 2-butenyl, 2-pentenyl, 3-methyl-2-pentenyl, 1-pentenyl, 2-hexenyl, 4-methyl-2-hexenyl groups, etc.; an optionally substituted aralkyl group containing 7 to 12 carbon atoms such as benzyl, phenyl, 3-phenylpropyl, naphthylmethyl, 2-naphthylethyl, chlorobenzyl, bromobenzyl, methylbenzyl, ethylbenzyl, methoxybenzyl, dimethylbenzyl, dimethoxybenzyl groups, etc.; an optionally substituted alicyclic group containing 5 to 8 carbon atoms such as cyclohexyl, 2-cyclohexyl, 2-cyclopentylethyl groups etc.; or an optionally substituted aromatic group containing 6 to 12 carbon atoms such as phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidephenyl, dodecyloylamidophenyl groups, etc.

In $-OR_9$ group, $R_9$ has the same meaning as $R_3$.

$R_6$, $R_7$ and $R_8$ may be same or different and have the same meaning as $R_3$. $R_4$ and $R_5$.

Examples of the recurring unit having a fluorine and/or silicon atom-containing substituent are given in the following without limiting the scope of the present invention.

(b-1)

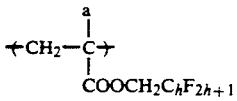

a = H, $CH_3$
h: integer of 1 ~ 12

-continued (b-2)

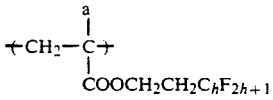

(b-3)

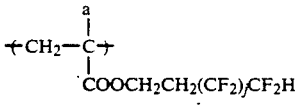

j: integer of 1 ~ 11

(b-4)

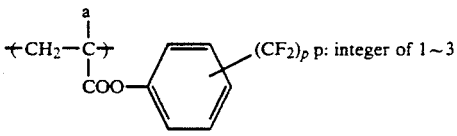

p: integer of 1 ~ 3

(b-5)

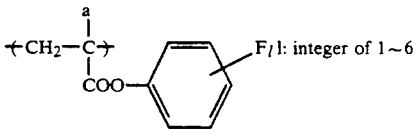

l: integer of 1 ~ 6

(b-6)

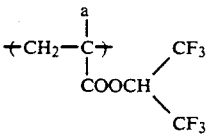

(b-7)

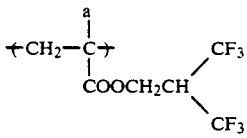

(b-8)

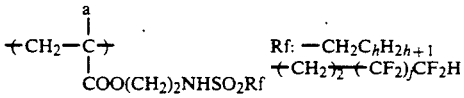

Rf: $-CH_2C_hH_{2h+1}$
$-(CH_2)_2-(CF_2)_jCF_2H$ (b-9)

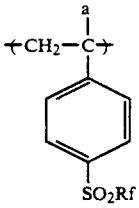

(b-10)

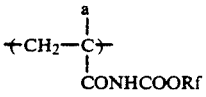

(b-11)

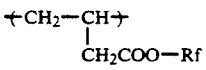

(b-12)

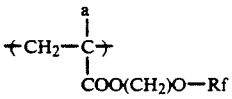

(b-13)

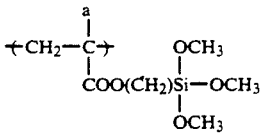

-continued (b-14)

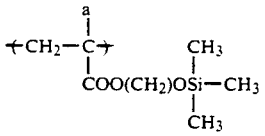

(b-15)

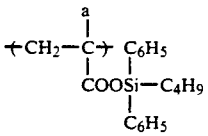

(b-16)

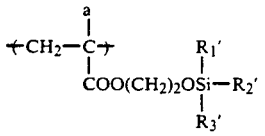

$R_1'$, $R_2'$, $R_3'$: alkyl group of $C_1 \sim C_{12}$ (b-17)

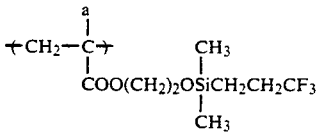

(b-18)

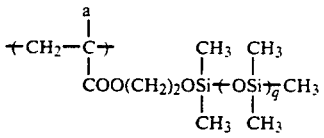

q: integer of $1 \sim 20$ (b-19)

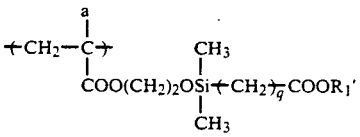

(b-20)

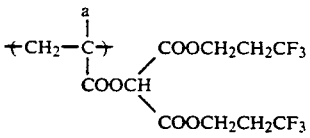

(b-21)

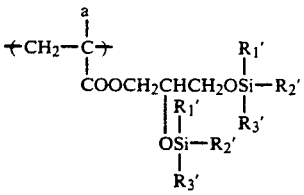

(b-22)

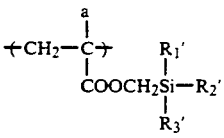

-continued (b-23)

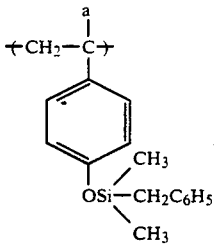

(b-24)

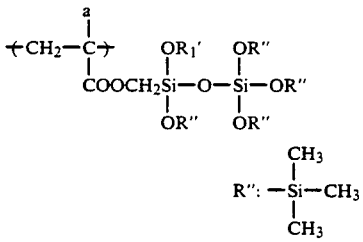

(b-25)

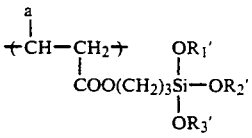

(b-26)

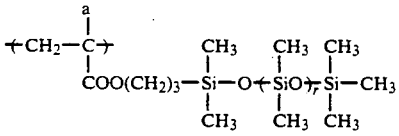

r: $30 \sim 150$ (b-27)

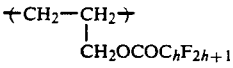

(b-28)

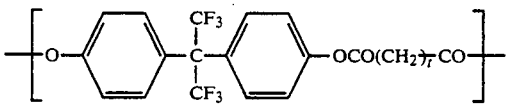

t: integer of $2 \sim 12$ (b-29)

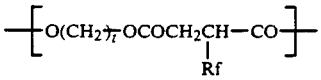

(b-30)

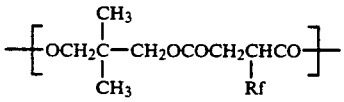

In the monofunctional polymer [M] of the present first invention, the foregoing polymerizable double bond group represented by the general formula (I) and one end of the polymer main chain containing at least the recurring units each having a fluorine atom- and/or silicon atom-containing substituent are bonded directly or through a suitable bonding group. As the bonding group, there can be used divalent organic residual radicals, for example, divalent aliphatic groups or divalent aromatic groups, which can be bonded through a bonding group selected from the group consisting of $$-O-,\ -S-,\ -\overset{d_1}{\overset{|}{N}}-,\ -SO-,\ -SO_2-,\ -COO-,$$

$$-OCO-,\ -CONHCO-,\ -NHCONH-,\ -\overset{d_2}{\overset{|}{CON}}-,$$

$$-\overset{d_3}{\overset{|}{SO_2N}}- \text{ and } -\underset{d_5}{\overset{d_4}{\overset{|}{\underset{|}{Si}}}}-,$$

individually or in combination. $d_1$ to $d_5$ have the same meaning as $R_1$ in the general formula.

Examples of the divalent aliphatic group are

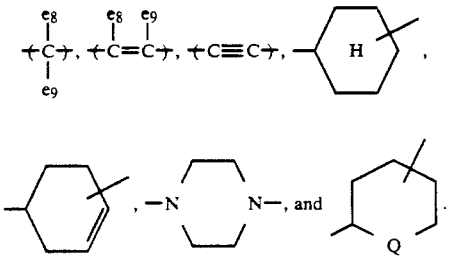

In these groups, $e_8$ and $e_9$ each represent a hydrogen atom, a halogen atom such as fluorine, chlorine and bromine atoms, etc.; or an alkyl group containing 1 to 12 carbon atoms such as methyl, ethyl, propyl, chloromethyl, bromomethyl, butyl, hexyl, octyl, nonyl, decyl groups, etc. and Q represents —O—, —S— or —NR-$_{20}$— wherein $R_{20}$ is an alkyl group containing 1 to 4 carbon atoms, —$CH_2Cl$ or —$CH_2Br$.

Examples of the divalent aromatic group are benzene ring group, naphthalene ring group and 5- or 6-membered heterocyclic ring groups each containing at least one hetero atom selected from the group consisting of oxygen atom, sulfur atom and nitrogen atom. These aromatic group can have at least one of substituents, for example, halogen atoms such as fluorine, chlorine, bromine atoms. etc.; alkyl groups containing 1 to 8 carbon atoms such as methyl, ethyl, propyl, butyl, hexyl, octyl groups, etc.; and alkoxy groups containing 1 to 6 carbon atoms such as methoxy, ethoxy, propioxy, butoxy groups, etc.

Examples of the heterocyclic ring group are furan, thiophene, pyridine, pyrazine, piperidine, tetrahydrofuran, pyrrole, tetrahydropyran, 1,3-oxazoline rings, etc.

Examples of the polymerizable double bond group represented by the general formula (I) in the monofunctional polymer [M] and a moiety composed of the organic radical bonded thereto are given in the following without limiting the scope of the present first invention, in which $P_1$ represents —H, —$CH_3$, —$CH_2COOCH_3$, —Cl, —Br or —CN, $P_2$ represents —H or —$CH_3$, X represents —Cl or —Br, n represents an integer of 2 to 12 and m represents an integer of 1 to 4.

$$CH_2{=}\overset{P_1}{\overset{|}{C}}-COO(CH_2)_n O- \quad \text{(C-1)}$$

$$CH_3{-}CH{=}CH-O(CH_2)_n O- \quad \text{(C-2)}$$

-continued $$CH_2{=}CH- \quad \text{(C-3)}$$

$$CH_2{=}CH-CH_2- \quad \text{(C-4)}$$

$$CH_2{=}\overset{P_1}{\overset{|}{C}}-COO(CH_2)_n NH- \quad \text{(C-5)}$$

$$CH_2{=}\overset{P_1}{\overset{|}{C}}-COOCH_2\underset{OH}{\underset{|}{CH}}CH_2O- \quad \text{(C-6)}$$

$$CH_2{=}\overset{P_1}{\overset{|}{C}}-CONH(CH_2)_n \quad \text{(C-7)}$$

$$CH_2{=}CH-\underset{OH}{\underset{|}{CH}}-CH_2O- \quad \text{(C-8)}$$

$$CH_2{=}\overset{P_1}{\overset{|}{C}}-COOCH_2\underset{SH}{\underset{|}{CH}}CH_2O- \quad \text{(C-9)}$$

(C-10)

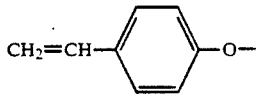

(C-11)

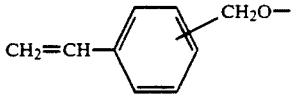

(C-12)

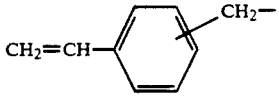

$$CH_2{=}\overset{P_1}{\overset{|}{C}}-COO(CH_2)_n \quad \text{(C-13)}$$

$$CH_2{=}\overset{P_1}{\overset{|}{C}}-CONH(CH_2)_n \quad \text{(C-14)}$$

$$CH_2{=}\overset{P_2}{\overset{|}{C}}-CONHCOO(CH_2)_n \quad \text{(C-15)}$$

$$CH_2{=}\overset{P_2}{\overset{|}{C}}-CONHCONH(CH_2)_n \quad \text{(C-16)}$$

$$CH_2{=}CH-CH_2-COO(CH_2)_n \quad \text{(C-17)}$$

(C-18)

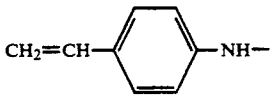

(C-19)

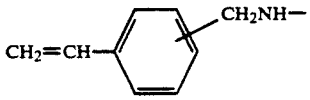

$$CH_2{=}\overset{P_2}{\overset{|}{C}}-COO\underset{CH_2CH_2X}{\underset{|}{CH}}O- \quad \text{(C-20)}$$

-continued (C-21)

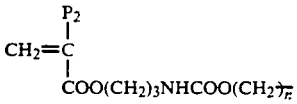

(C-22)

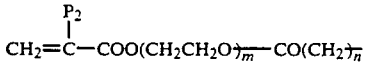

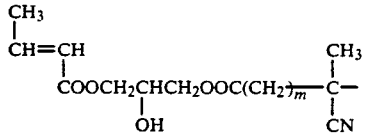

(C-23)

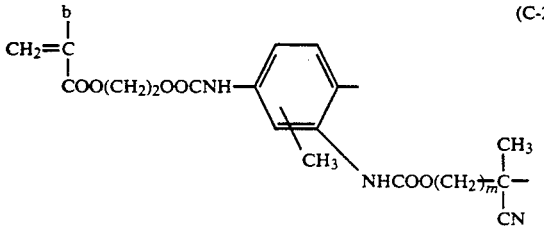

(C-24)

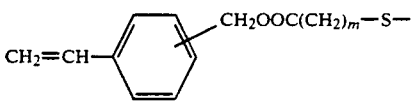

$CH_2=CH-CH_2OCO(CH_2)_m-S-$ (C-25)

(C-26)

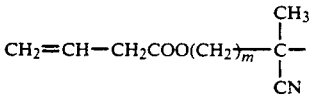

(C-27)

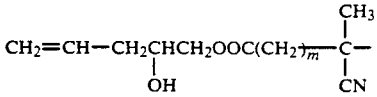

(C-28)

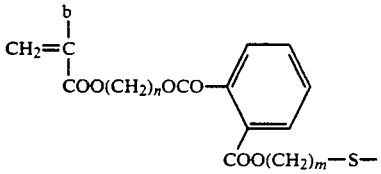

(C-29)

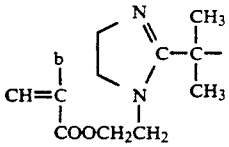

(C-30)

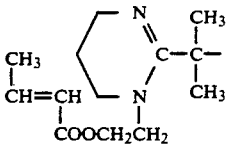

In the sum of the recurring units of the monofunctional polymer [M] of the present first invention, the recurring units each having a fluorine atom and/or silicon atom-containing substituent are present preferably in a proportion of at least 40% by weight, more preferably 60 to 100% by weight based on the whole quantity.

If the above described component is less than 40% by weight to the whole quantity, the concentrating effect in the surface part is deteriorated when the resin grains are dispersed in the photoconductive layer, thus decreasing the effect of improving the water retention as a printing plate precursor.

In the present second invention, the monofunctional monomer (B) containing a substituent containing at least one of fluorine atom and silicon atom, to be copolymerized with the foregoing polar group-containing monomer (A) can be chosen from any compounds capable of satisfying the above described conditions. The specified substituent will be illustrated in the following without limiting the scope of the present invention.

As the fluorine atom-containing substituents and the silicon atom-containing substituents, there can be used those contained in the recurring unit of the monofunctional polymer [M] in the present first invention.

Examples of the monofunctional monomer (B) having a fluorine atom- and/or silicon atom-containing substituent will be given in the following without limiting the scope the present invention:

(b'-1)

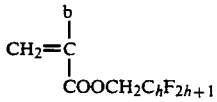

a = H, $CH_3$
h: integer of 1~12

(b'-2)

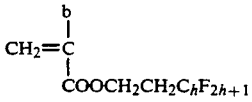

(b'-3)

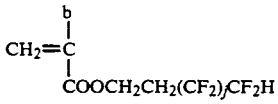

j: integer of 1~11

(b'-4)

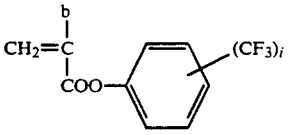

i: integer of 1~3

(b'-5)

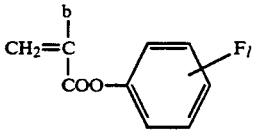

l: integer of 1~6

(b'-6)

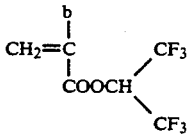

(b'-7)

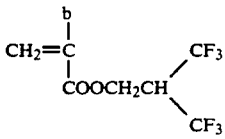

-continued
(b'-8)
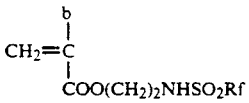
Rf: $-CH_2C_hH_{2h+1}$
$\leftarrow CH_2\rightarrow_2 \leftarrow CF_2\rightarrow_j CF_2H$
(b'-9)
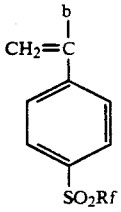
(b'-10)
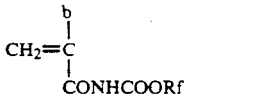
(b'-11)
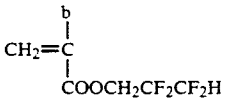
(b'-12)
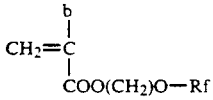
(b'-13)
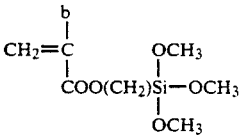
(b'-14)
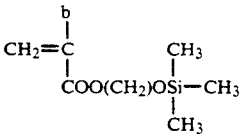
(b'-15)
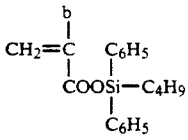
(b'-16)
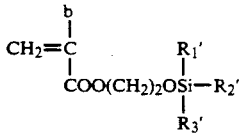
$R_1'$, $R_2'$, $R_3'$: alkyl group of $C_1 \sim C_{12}$
(b'-17)
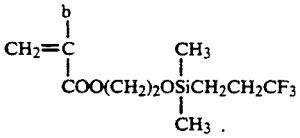
(b'-18)
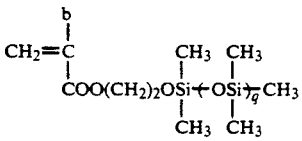
q: integer of 1~20
-continued
(b'-19)
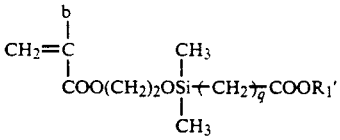
(b'-20)
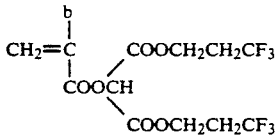
(b'-21)
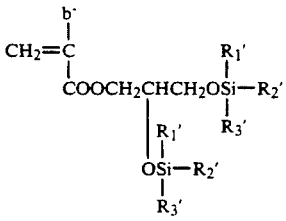
(b'-22)
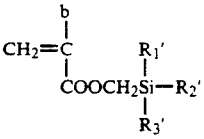
(b'-23)
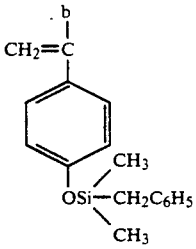
(b'-24)
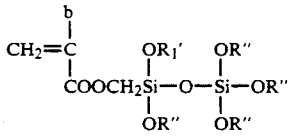
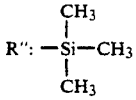
R'': $-Si(CH_3)_2-CH_3$
(b'-25)
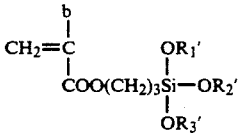
(b'-26)
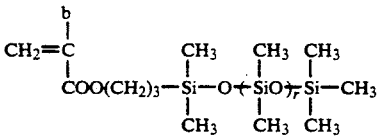
r: 0 or integer of 1~20
(b'-27)
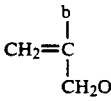

-continued

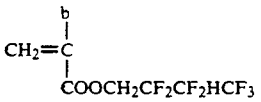

(b'-28)

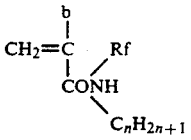

(b'-29)

In addition to the above described polar group-containing monomer (A) and the fluorine atom- and/or silicon atom-containing monomer (B), other monomers to be copolymerized therewith can be contained as a polymeric component.

As the other monomers, there can be used monomers corresponding to the recurring unit of the general formula (IV), described hereinafter, and monomers to be copolymerized with the monomers corresponding to the components represented by the general formula (IV).

As the polymeric components in the resin grains, the monomer (A) is present in a proportion of preferably at least 30% by weight, more preferably at least 50% by weight and the monomer (B) is present in a proportion of preferably 0.5 to 30% by weight, more preferably 1 to 20% by weight. In the case of containing the other copolymerizable monomer, the quantity thereof should preferably be 20% by weight or less.

It is important that the polymeric component becoming insoluble in a non-aqueous solvent should have such a hydrophilic property that the contact angle with distilled water is at most 50 degrees or less, as defined above.

The dispersion-stabilizing resin used in the second invention will be illustrated. Herein, it is important that the dispersion-stabilizing resin is subject to solvation and soluble in the non-aqueous solvent, and functions to stabilize the dispersion in the so-called non-aqueous dispersion polymerization. Specifically, the resin should be chosen from those having such a solubility that at least 5% by weight of it is dissolved in 100 parts by weight of the solvent at 25° C.

The weight average molecular weight of the dispersion-stabilizing resin is generally in the range of $1\times10^3$ to $5\times10^5$, preferably $2\times10^3$ to $1\times10^5$, more preferably $3\times10^3$ to $5\times10^4$. If the weight average molecular weight of the resin is less than $1\times10^3$, the resulting dispersed resin grains tend to aggregate, so that fine grains whose average grain diameters are uniform can hardly he obtained while if more than $5\times10^5$, the advantage of the present invention will rather be decreased that the addition thereof to a photoconductive layer results in improving the water retention while satisfying the electrophotographic property.

As the dispersion-stabilizing resin of the present invention, any polymer soluble in the non-aqueous solvent can be used, for example, described in K. E. J. Barrett, "Dispersion Polymerization in Organic Media" published by John Wiley and Sons in 1975; R. Dowpenco and D. P. Hart, "Ind. Eng. Chem. Prod. Res. Develop." 12 (No. 1), 14 (1973); Toyokichi Tange, "Nippon Setchaku Kyokaishi" 23 (1), 26 (1987); D. J. Walbridge, "NATO. Adv. Study Inst. Ser. E." No. 67, 40 (1983); Y. Sasaki and M. Yabuta, "Proc. 10th, Int. Conf. Org. Coat. Sci. Technol." 10, 263 (1984).

For example, these polymers include olefin polymers, modified olefin polymers, styrene-olefin copolymers, aliphatic carboxylic acid vinyl ester copolymers, modified maleic anhydride copolymers, polyester polymers, polyether polymers, methacrylate homopolymers, acrylate homopolymers, methacrylate copolymers, acrylate copolymers, alkyd resins and the like.

More specifically, the polymeric component as the recurring unit of the dispersion-stabilizing of the present invention is represented by the following general formula (IV):

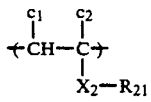

General Formula (IV)

wherein $X_2$ has the same meaning as $V_0$ of the formula (II), the detail of which is illustrated in the illustration of $V_0'$ of the formula (II).

$R_{21}$ is an optionally substituted alkyl group containing 1 to 22 carbon atoms, such as methyl, ethyl, propyl, butyl, pentyl, hexyl, octyl, nonyl, decyl, dodecyl, tridecyl, tetradecyl, hexadecyl, octadecyl, docosanyl, 2-(N,N-dimethylamino)ethyl, 2-(N-morpholino)ethyl, 2-chloroethyl, 2-bromoethyl, 2hydroxyethyl, 2-cyanoethyl, 2-(α-thienyl)ethyl, 2-carboxyethyl, 2-methoxycarbonylethyl, 2,3-epoxypropyl, 2,3-diacetoxypropyl, 3-chloropropyl and 4-ethoxycarbonylbutyl groups; an optionally substituted alkenyl group containing 3 to 22 carbon atoms, such as allyl, hexenyl, octenyl, decenyl, dodecenyl, tridecenyl, octadecenyl, oleoyl and linoleyl groups; an optionally substituted aralkyl group containing 7 to 22 carbon atoms, such as benzyl, phenethyl, 3-phenylpropyl, 2-naphthylmethyl, 2-(2'-naphthyl-)ethyl, chlorobenzyl, bromobenzyl, methylbenzyl, dimethylbenzyl, trimethylbenzyl, methoxybenzyl, dimethoxybenzyl, butylbenzyl and methoxycarbonylbenzyl groups; an optionally substituted alicyclic group containing 4 to 12 carbon atoms, such as cyclopentyl, cyclohexyl, cyclooctyl, adamantyl, chlorocyclohexyl and methoxycyclohexyl groups; and an optionally substituted aromatic groups containing 6 to 22 carbon atoms, such as phenyl, tolyl, xylyl, mesityl, naphthyl, anthranyl, chlorophenyl, bromophenyl, butylphenyl, hexylphenyl, octylphenyl, decylphenyl, dodecylphenyl, methoxyphenyl, ethoxyphenyl, octyloxyphenyl, ethoxycarbonylphenyl, acetylphenyl, butoxycarbonylphenyl, butylmethylphenyl, N,N-dibutylaminophenyl, N-methyl-N-dodecylphenyl, thienyl and hiranyl groups.

$c_1$ and $c_2$ have the same meanings as $a_1'$ and $a_2'$ in the general formula (II), the details of which are illustrated in the illustration of $a_1'$ and $a_2'$ in the general formula (II).

In addition to the above described components, other polymeric components can be incorporated as the polymeric component in the dispersion-stabilizing resin of the present invention.

As the other polymeric component, there can be used any monomers to be copolymerized with the monomer corresponding to the component represented by the general formula (IV), for example, α-olefins, acrylonitrile, methacrylonitrile, vinyl-containing heterocyclic compounds (heterocyclic rings: pyrane, pyrrolidone, imidazole, pyridine rings), vinyl group-containing carboxylic acids such as acrylic acid, methacrylic acid, crotonic acid, itaconic acid, maleic acid and the like and vinyl group-containing carboxamides such as acrylamide, methacrylamide, crotonylamide, itaconylamide, itaconylsemi-amide and itaconyldiamide and the like.

In the dispersion-stabilizing resin of the present invention, the polymeric component represented by the general formula (IV) is present in proportion of, preferably at least 30 parts by weight, more preferably at least 50 parts by weight to 100 parts by weight of the whole polymers of the resin.

Furthermore, the dispersion-stabilizing resin of the present invention preferably contains at least one polymerizable double bond group represented by the foregoing general formula (II) in the polymer chain.

The polymerizable double bond group will now be illustrated in detail:

General Formula (II)

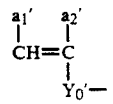

wherein $V_0'$ is —O—, —COO—, —OCO—, $-(CH_2)_p-OCO-$, $-(CH_2)_p-COO-$, $-SO_2-$,

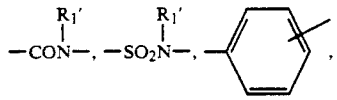

—CONHCOO— or —CONHCONH—

(p is an integer of 1 to 4 and $R_1'$ is a hydrogen atom or a hydrocarbon group containing 1 to 18 carbon atoms), and $a_1'$ and $a_2'$ are, same or different, hydrogen atoms, halogen atoms, cyano groups, hydrocarbon groups, —COO—$R_2'$— or —COO—$R_2'$— via a hydrocarbon group ($R_2'$ is a hydrogen atom or optionally substituted hydrocarbon group).

Specifically, $R_1'$ has the same meaning as $R_1$ in the general formula (I).

When $V_0'$ represents

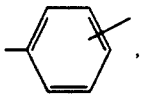

the benzene ring can have a substituent. As the substituent, there can be used halogen atoms such as chlorine, bromine atoms, etc.; alkyl groups such as methyl, ethyl, propyl, butyl, chloromethyl, methoxymethyl groups, etc.; and alkoxy groups such as methoxy, ethoxy, propioxy, butoxy groups.

$a_1'$ and $a_2'$ represents preferably, same of different, hydrogen atoms, halogen atoms such as chlorine, bromine atoms, etc.; cyano group; alkyl groups containing 1 to 4 carbon atoms such as methyl, ethyl, propyl, butyl groups, etc.; and —COO—$R_2'$ or —COO—$R_2'$ via a hydrocarbon group, wherein $R_2'$ is a hydrogen atom, an alkyl group containing 1 to 18 carbon atoms, an alkenyl group, an aralkyl group, an alicyclic group or an aryl group, which can be substituted and specifically, which has the same meaning as $R_1'$.

The hydrocarbon group in the above described "—COO—$R_2'$ via a hydrocarbon group" includes methylene, ethylene, propylene groups, etc.

In the general formula (II), more preferably, $V_0'$ represents —COO—, —OCO—, $-CH_2OCO-$, $-CH_2COO-$, —O—, —CONH—, $-SO_2NH-$, —CONHCOO— or

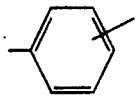

and $a_1'$ and $a_2'$ represent, same or different, hydrogen atoms, methyl group, —$COOR_2'$ or —$CH_2COOR_2'$, wherein $R_2'$ is a hydrogen atom or an alkyl group containing 1 to 6 carbon atoms such as methyl, ethyl, propyl, butyl, hexyl groups, etc. Most preferably, either of $a_1'$ and $a_2'$ is surely a hydrogen atom.

Examples of the part containing polymerizable double bond group represented by the general formula (II) includes those exemplified as to the general formula (I) of the present first invention.

These polymerizable double bond group-containing parts are bonded to the polymer main chain directly or via suitable bonding groups, illustrative of which are those exemplified as the bonding groups for bonding the polymerizable double bond group represented by the general formula (I) and one end of the polymer main chain containing at least the recurring units each having a fluorine atom- and/or silicon atom-containing substituent in the present first invention.

Specifically, the above described polymerizable bond group-containing part is random-bonded in the polymer main chain or bonded to only one end of the polymer main chain. The polymer, in which the polymerizable double bond group-containing part is bonded to only one end of the polymer main chain, is preferably used (which will hereinafter be referred to as "monofunctional polymer [M]").

Examples of the polymerizable double bond group part represented by the general formula (II) in the monofunctional polymer [M] and a moiety composed of the organic radical bonded thereto include those exemplified in the present first invention.

Preferably, the dispersion-stabilizing resin of the present second invention contains the polymerizable double bond group in the side chain of the polymer, which can be produced by the prior art method.

For example, there are (1) a method comprising copolymerizing a monomer containing two polymerizable double bond groups differing in polymerization reactivity in the molecule, (2) a method comprising copolymerizing a monofunctional monomer containing a reactive group such as carboxyl, hydroxyl, amino; epoxy groups, etc. in the molecules to obtain a polymer and then subjecting to the so-called polymer reaction with an organic low molecular compound containing a polymerizable double bond group containing another reactive group capable of chemically bonding with the reactive group in the side chain of the polymer, as well known in the art.

As the above described method (1), for example, there is a method disclosed in Japanese Patent Laid-Open Publication No. 185962/1985.

As the above described method (2), for example, there are methods disclosed in Yoshio Iwakura and Keisuke Kurita, "Hannosei Kobunshi (Reactive Polymers)" published by Kohdansha (1977); Ryohei Oda, "Kobunshi Fine Chemical (High Molecular Fine Chemical)" published by Kodansha (1976), Japanese Patent Laid-Open Publication No. 43757/1986 and Japanese Patent Application No. 149305/1989.

The polymer reaction by combination of functional groups classified as Group A and functional groups classified as Group B, shown in Table 1, is exemplified as the ordinary well-known method. In Table 1, $R_{22}$ and $R_{23}$ are hydrocarbon groups having the same contents as $l_8$ and $l_9$ in $L_1$ of the foregoing formula (III).

TABLE 1

| Group A | Group B |
|---|---|
| —COOH, —$PO_3H_2$ | 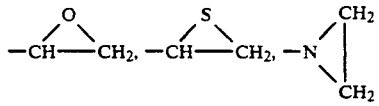 |
| —OH, —SH | |
| —$NH_2$ | —COCl, —$SO_2Cl$ |
| | cyclic acid anhydride |
| —$SO_2H$ | —N=C=O, —N=C=S |
| | 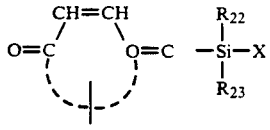 |

(X = Cl, Br)

The monofunctional polymer [M] of the present first or second invention can be produced by the synthesis method of the prior art, for example, (1) an ion polymerization method comprising reacting the end of a living polymer obtained by an anion or cation polymerization with various reagents to obtain a mono functional polymer [M], (2) a radical polymerization method comprising reacting a polymer having an end-reactive group bonded, obtained by radical polymerization using a chain transferring agent and/or polymerization initiator containing a reactive group such as carboxyl group, hydroxyl group, amino group, etc. in the molecule with various reagents to obtain a monofunctional polymer [M], (3) a polyaddition condensation method comprising introducing a polymerizable double bond group into a polymer obtained by polyaddition or polycondensation method in the similar manner to the described above radical polymerization method and the like.

For example, these methods are described in P. Drefuss & R. P. Quirk, "Encycl. Polym. Sci. Eng.", 7, 551 (1987), P. F. Rempp, E. Franta, "Adv. Polym. Sci.", 58, 1(1984), V. Percec, "Appl. Poly. Sci.", 285, 95 (1984), R. Asami, M. Takari, "Makromol. Chem. Suppl.", 12, 163 (1985), P. Rempp et al., "Makromol. Chem. Suppl.", 8, 3(1987), Yusuke Kawakami, "Kagaku Kogyo (Chemical Industry)" 38, 56 (1987), Yuya Yamashita, "Kobunshi (Polymer)" 31, 988 (1982), Shiro Kobayashi, "Kobunshi (Polymer)" 30, 625 (1981), Toshinobu Higashimura, "Nippon Setchaku Kyokaishi (Japan Adhesive Association)" 18, 536 (1982), Koichi Ito, "Kobunshi Kako (Polymer Processing)" 35, 262 (1986), and Kishiro Azuma and Takashi Tsuda, "Kino Zairyo (Functional Materials)" 1987, No. 10, 5.

As the synthesis method of the monofunctional polymer [M] described above, more specifically, there are a method for producing the polymer [M] containing a recurring unit corresponding to the radical-polymerizable monomer, as described in Japanese Patent Laid-Open Publication No. 67563/1990 and Japanese Patent Application Nos. 64970/1988, 206989/1989 and 69011/1989, and a method for producing the monofunctional polymer [M] containing a recurring unit corresponding to the polyester or polyether structure, as described in Japanese Patent Application Nos. 56379/1989, 58989/1989 and 56380/1989.

The dispersed resin grains of the present second invention are copolymer resin grains obtained by dispersion polymerization of the monofunctional monomer (A) containing a polar group and a monofunctional monomer (B) containing silicon atom and/or fluorine atom in the presence of the above described dispersion stabilizing resin.

When the dispersed resin grains of the present first invention have network structures, polymers composed of the above described polar group-containing monofunctional monomers (A) as a polymeric component hereinafter referred to as "polymeric component" (A)) are crosslinked with each other to form a high order network structure.

That is, the dispersed resin grains of the present first invention are a non aqueous latex composed of a part insoluble in a non-aqueous dispersing solvent, consisting of the polymeric component (A), and the monofunctional polymer [M] soluble in the solvent, and when having a network structure, the polymeric component (A) composing the insoluble part in the solvent is subject to crosslinking between the molecules thereof.

Thus, the network resin grains are hardly or not soluble in water and specifically, the solubility of the resin in water is at most 80% by weight, preferably at most 50% by weight.

When the dispersed resin grains of the present second invention have network structures, polymers composed of the above described polar group-containing monofunctional monomers (A) and fluorine atom- and/or silicon atom-containing monofunctional monomer (B) as a polymeric component [hereinafter referred to as "polymeric component" (A)] are crosslinked with each other to form a high order network structure.

That is, the dispersed resin grains of the present second invention are a non-aqueous latex composed of a part insoluble in a non-aqueous dispersing solvent, consisting of the polymeric component (A), and the polymer soluble in the solvent, and when having a network structure, the polymeric component (A) composing the insoluble part in the solvent is subject to crosslinking between the molecules thereof.

Thus, the network resin grains are hardly or not soluble in water and specifically, the solubility of the resin in water is at most 80% by weight, preferably at most 50% by weight.

The crosslinking according to the present invention can be carried out by known methods, that is, (1) method comprising crosslinking a polymer containing the polymeric component (A) with various crosslinking agents or hardening agents, (2) method comprising polymerizing a monomer corresponding to the polymeric component (A) in the presence of a multifunctional monomer or multifunctional oligomer containing two or more polymerizable functional groups to form a network structure among the molecules and (3) method comprising subjecting polymers containing the polymeric components (A) and components containing reactive groups to polymerization reaction or polymer reaction and thereby effecting crosslinking.

As the crosslinking agent in the above described method (1), there can be used compounds commonly used as crosslinking agents, for example, described in Shinzo Yamashita and Tosuke Kaneko "Handbook of Crosslinking Agents (Kakyozai Handbook)" published by Taiseisha (1981) and Kobunshi Gakkai Edition "High Molecular Data Handbook -Basis- (Kobunshi Data Handbook -Kisohen-)" published by Baihunkan (1986).

Examples of the crosslinking agent are organosilane compounds such as vinyltrimethoxysilane, vinyltributoxysilane, γ-glycidoxypropyltrimethoxysilane, γ-mercaptopropyltriethoxysilane, γ-aminopropyltriethoxysilane and other silane coupling agents; polyisocyanate compounds such as tolylene diisocyanate, o-tolylene diisocyanate, diphenylmethane diisocyanate, triphenylmethane diisocyanate, polymethylenepolyphenyl isocyanate, hexamethylene diisocyanate, isophorone diisocyanate, high molecular polyisocyanates; polyol compounds such as 1,4-butanediol, polyoxypropylene glycol, polyoxyalkylene glycol, 1,1,1-trimethylolpropane and the like; polyamine compounds such as ethylenediamine, γ-hydroxypropylated ethylenediamine, phenylenediamine, hexamethylenediamine, N-aminoethylpiperazine, modified aliphatic polyamines and the like; polyepoxy group-containing compounds and epoxy resins, for example, as described in Kakiuchi Hiroshi "New Epoxy Resins (Shin Epoxy Jushi)" published by Shokodo (1985), and Kuniyuki Hashimoto "Epoxy Resins (Epoxy Jushi)" published by Nikkan Kogyo Shinbunsha (1969); melamine resins such as described in Ichiro Miwa and Hideo Matsunaga "Urea and Melamine Resins (Urea-Melamine Jushi)" published by Nikkan Kogyo Shinbunsha (1969); and poly(-meth)acrylate compounds as described in Shin Ogawara, Takeo Saegusa and Toshinobu Higashimura "Oligomers" published by Kodansha (1976) and Eizo Omori "Functional Acrylic Resins" published by Technosystem (1985), for example, polyethylene glycol diacrylate, neopentyl glycol diacrylate, 1,6-hexanediol diacrylate, trimethylolpropane triacrylate, pentaerythritol polyacrylate, bisphenol A-diglycidyl ether diacrylate, oligoester acrylate and methacrylates thereof and the like.

Examples of the polymerizable function group of the multifunctional monomer [hereinafter referred to as multifunctional monomer (D) sometime] or multifunctional oligomer containing at least two polymerizable functional groups, used in the above described method (2), are:

$$CH_2{=}CH{-}CH_2{-},\ CH_2{=}CH{-}\overset{\overset{\displaystyle O}{\|}}{C}{-}O{-},\ CH_2{=}CH{-},$$

$$CH_2{=}\overset{\overset{\displaystyle CH_3}{|}}{C}{-}\underset{\underset{\displaystyle O}{\|}}{C}{-}O{-},\ \overset{\overset{\displaystyle CH_3}{|}}{CH}{=}CH{-}\overset{\overset{\displaystyle O}{\|}}{C}{-}O{-},\ CH_2{=}CH{-}CONH{-},$$

$$CH_2{=}\overset{\overset{\displaystyle CH_3}{|}}{C}{-}CONH{-},\ \overset{\overset{\displaystyle CH_3}{|}}{CH}{=}CH{-}CONH{-},$$

$$CH_2{=}CH{-}O{-}\overset{\overset{\displaystyle O}{\|}}{C}{-},\ CH_2{=}\overset{\overset{\displaystyle CH_3}{|}}{C}{-}O{-}\overset{\overset{\displaystyle O}{\|}}{C}{-},$$

$$CH_2{=}CH{-}CH_2{-}O{-}\overset{\overset{\displaystyle O}{\|}}{C}{-},\ CH_2{=}CH{-}NHCO{-},$$

-continued $$CH_2{=}CH{-}CH_2{-}NHCO{-},\ CH_2{=}CH{-}SO_2{-},$$
$$CH_2{=}CH{-}CO{-},\ CH_2{=}CH{-}O{-},\ CH_2{=}CH{-}S{-}.$$

Any of monomers or oligomers containing two or more same or different ones of these polymerizable functional groups can be used in the present invention.

Of these monomers or oligomers, as the monomer or oligomer having two or more same polymerizable functional groups, there can be used styrene derivatives such as divinyl benzene and trivinyl benzene; esters of polyhydric alcohols such as ethylene glycol, diethylene glycol, triethylene glycol, polyethylene glycols Nos. 200, 400 and 600, 1,3-butylene glycol, neopentyl glycol, dipropylene glycol, polypropylene glycol, trimethylol propane, trimethylolethane, pentaerythritol and the like or polyhydroxyphenols such as hydroquinone, resorcinol, catechol and derivatives thereof with methacrylic acid, acrylic acid or crotonic acid, vinyl ethers and allyl ethers; vinyl esters of dibasic acids such as malonic acid, succinic acid, glutaric acid, adipic acid, pimelic acid, maleic acid, phthalic acid, itaconic acid and the like, allyl esters, vinylamides and allylamides; and condensates of polyamines such as ethylenediamine, 1,3-propylenediamine, 1,4-butylenediamine and the like with carboxylic acids containing vinyl groups such as methacrylic acid, acrylic acid, crotonic acid, allylacetic acid and the like.

As the monomer or oligomer having two or more different polymerizable functional groups, there can be used, for example, ester derivatives or amide derivatives containing vinyl groups of carboxylic acids containing vinyl group, such as methacrylic acid, acrylic acid, methacryloylacetic acid, acryloylacetic acid, methacryloylpropionic acid, acryloylpropionic acid, itaconyloylacetic acid and itaconyloylpropionic acid, reaction products of carboxylic anhydrides with alcohols or amines such as allyloxycarbonylpropionic acid, allyloxycarbonylacetic acid, 2-allyloxycarbonylbenzoic acid, allylaminocarbonylpropionic acid and the like, for example, vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, 2-(vinyloxycarbonyl)ethyl ester of acrylic acid, N-allylacrylamide, N-allylmethacrylamide, N-allylitaconamide, methcaryloylpropionic acid allylamide and the like; and condensates of amino alcohols such as aminoethanol, 1-aminopropanol, 1-aminobutanol, 1-aminohexanol, 2-aminobutanol and the like with carboxylic acids containing vinyl groups.

The monomer or oligomer containing two or more polymerizable functional groups of the present invention is generally used in a proportion of at most 10 mole%, preferably at most 5 mole % to the sum of the monomer (A) and other monomers coexistent, which is polymerized to form a resin.

The crosslinking of polymers by reacting reactive groups among the polymers and forming chemical bonds according to the foregoing method (3) can be carried out in the similar manner to the ordinary reactions of organic low molecular compounds, for example, as disclosed in Yoshio Iwakura and Keisuke Kurita "Reactive Polymers (Hannosei Kobunshi)" published by Kohdansha (1977) and Ryohei Oda "High Molecular Fine Chemical (Kobunshi Fine Chemical)" published by Kohdansha (1976).

As well known in the art, for example, the polymer reactions by combination of the functional groups as classified as Groups A and B of Table 1 are carried out.

As illustrated above, the network dispersed resin grains of the first invention are polymer grains comprising polymeric components containing polar groups and polymeric components containing recurring units having fluorine atom- and/or silicon atom-containing substituents, and having high order crosslinked structures among the molecular chains. On the other hand, the network dispersed resin grains of the second invention are polymer grains comprising polymeric components containing recurring units having polar groups and recurring units having fluorine atom- and/or silicon atom containing substituents, and polymeric components soluble in the non-aqueous solvent, and having high order crosslinked structures among the molecular chains.

In the dispersion polymerization, the method (2) using the multifunctional monomer is preferred as a method of forming a network structure because of obtaining grains of monodisperse system with a uniform grain diameter and tending to obtain fine grains with a grain diameter of at most 0.5 μm.

As the non-aqueous solvent for the preparation of the non-aqueous solvent-dispersed resin grains, there can be used any of organic solvents having a boiling point of at most 200° C., individually or in combination. Useful examples of the organic solvent are alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing 6 to 14 carbon atoms such as hexane, octane, decane, dodecane, tridecane, cyclohexane and cyclooctane, aromatic hydrocarbons such as benzene, toluene, xylene and chlorobenzene and halogenated hydrocarbons such as methylene chloride, dichloroethane, tetrachloroethane, chloroform, methylchloroform, dichloropropane and trichloroethane. The present invention is not intended to be limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of monodisperse system with a very narrow distribution of grain diameters. Such a method is described in, for example K. E. J. Barrett "Dispersion Polymerization in Organic Media" John Wiley & Sons (1975), Koichiro Murata "Polymer Processings (Kobunshi Kako)" 23, 20 (1974), Tsunetaka Matsumoto and Toyokichi Tange "Journal of Japan Adhesive Association (Nippon Setchaku Kyokaishi)" 9, 183 (1973), Toyokichi Tange "Journal of Japan Adhesive Association" 23, 26 (1987), D. J. Walbridge "NATO. Adv. Study Inst. Ser. E." No. 67, 40 (1983), British Patent Nos. 893,429 and 934,038 and U.S. Pat. Nos. 1,122,397, 3,900,412 and 4,606,989, and Japanese Patent Laid-Open Publication Nos. 179751/1985 and 185963/1985.

The dispersed resin of the present first invention consists of at least one of the monomer (A) and at least one of the monofunctional polymers [M] and optionally contains the multifunctional monomer (D) when a network structure is formed. In any case, it is important that if a resin synthesized from such a monomer is insoluble in the non-aqueous solvent, a desired dispersed resin can be obtained. More specifically, it is preferable to use 1 to 50% by weight, more preferably 5 to 25% by weight of the monofunctional monomer [M] for the monomer (A) to be insolubilized. The dispersed resin of the present first invention has a molecular weight of $10^4$ to $10^6$, preferably $10^4$ to $5\times10^5$.

Preparation of the dispersed resin grains used in the present first invention is carried out by heating and polymerizing the monomer (A), monofunctional polymer [M] and further the multifunctional monomer (D) in the presence of a polymerization initiator such as benzoyl peroxide, azobisisobutyronitrile, butyllithium, etc. in a non-aqueous solvent. Specifically, there are (1) a method comprising adding a polymerization initiator to a mixed solution of the monomer (A), monofunctional polymer [M] and multifunctional monomer (D), (2) a method comprising adding dropwise or suitably a mixture of the above described polymerizable compounds and polymerization initiator to a non-aqueous solvent, but of course, any other suitable methods can be employed without limiting to these methods.

The dispersed resin of the present second invention consists of at least one of the monomers (A), at least one of the monomers (B) and at least one of the dispersion stabilizing resins and optionally contains the multifunctional monomer (D) when a network structure is formed. In any case, it is important that if a resin synthesized from such a monomer is insoluble in the non-aqueous solvent, a desired dispersed resin can be obtained. More specifically, it is preferable to use 1 to 50% by weight, more preferably 2 to 30% by weight of the dispersion stabilizing resin for the monomer (A) to be insolubilized and the monomer (B) and the dispersed resin of the present first invention has a molecular weight of $10^4$ to $10^6$, preferably $10^4$ to $5\times10^5$.

Preparation of the dispersed resin grains used in the present second invention is carried out by heating and polymerizing the monomer (A), monomer (B), dispersion stabilizing resin and further the multifunctional monomer (D) in the presence of a polymerization initiator such as benzoyl peroxide, azobisisobutyronitrile, butyllithium, etc. in a non-aqueous solvent. Specifically, there are (1) a method comprising adding a polymerization initiator to a mixed solution of the monomer (A), monomer (B), dispersion stabilizing resin and multifunctional monomer (D), (2) a method comprising adding dropwise or suitably a mixture of the above described polymerizable compounds and polymerization initiator to a non-aqueous solvent, but of course, any other suitable methods can be employed without limiting to these methods.

The total amount of the polymerizable compounds is 5 to 80 parts by weight, preferably 10 to 50 parts by weight per 100 parts by weight of the non-aqueous solvent.

The amount of the polymerization initiator is 0.1 to 5% by weight of the total amount of the polymerizable compounds. The polymerization temperature is about 50° to 180° C., preferably 60° to 120° C. in the present first invention and about 30° to 180° C., preferably 40° to 120° C. in the present second invention. The reaction time is preferably 1 to 15 hours.

Thus, the non-aqueous dispersed resin prepared by the present invention becomes fine grains with a uniform grain size distribution.

As the binder resin of the present invention, there can be used all of known resins, typical of which are alkyd resins, vinyl acetate resins, polyester resins, styrene-butadiene resins, acrylic resins, etc., as described in Takaharu Kurita and Jiro Ishiwataru "High Molecular Materials (Kobunshi)" 17, 278 (1968) and Harumi Miyamoto and Hidehiko Takei "Imaging" No. 8, page 9 (1973).

Preferably, there are used random copolymers containing, as a polymeric component, methacrylates known as a binder resin of an electrophotographic light-sensitive material using photoconductive zinc oxide as an inorganic photoconductor, for example, described in Japanese Patent Publication Nos. 2242/1975, 31011/1975, 13977/1979 and 35013/1984 and Japanese Patent Laid-Open Publication Nos. 98324/1975, 98325/1975, 20735/1979 and 202544/1982.

Furthermore, there are used binder resins each consisting of a random copolymer of a methacrylate and a monomer containing an acidic component such as carboxyl group, sulfo group, phosphono group, etc., having a weight average molecular weight of at most $2\times10^4$, and another resin having a weight average molecular weight of at least $3\times10^4$ or a heat and/or light-hardenable compound, in combination, for example, described in Japanese Patent Laid-Open Publication Nos. 220148/1988, 220149/1988, 34860/1990, 40660/1990, 53064/1990 and 102573/1989; binder resins each consisting of a polymer containing methacrylate component and containing an acid group bonded to one end of the polymer main chain, having a weight-average molecular weight of at most $2\times10^4$, and another resin having a weight-average molecular weight of at least $3\times10^4$ or a heat and/or light-hardenable compound, in combination, for example, described in Japanese Patent Laid-Open Publication Nos. 169455/1989, 280761/1989, 214865/1989 and 874/1990 and Japanese Patent Application Nos. 221485/1988, 220442/1988 and 220441/1988, etc.

The inorganic photoconductive material used in the present invention is photoconductive zinc oxide. Further, other inorganic photoconductive materials can jointly be used, for example, titanium oxide, zinc sulfide, cadmium sulfide, cadmium carbonate, zinc selenide, cadmium selenide, tellurium selenide, lead sulfide and the like. However, these other photoconductive materials should be in a proportion of at most 40% by weight, preferably at most 20% by weight of the photoconductive zinc oxide, since if the amount of the other photoconductive material exceeds 40% by weight, the effect of improving the hydrophilic property of a non-image area as a lithographic printing plate precursor will be deceased.

The total amount of the binder reins used for the inorganic photoconductive materials is 10 to 100 parts by weight, preferably 15 to 50 parts by weight to 100 parts by weight of the photoconductive material.

In the present invention, if necessary, various coloring matters or dyes can be used as a spectro sensitizer, illustrative of which are carbonium dyes, diphenylmethane dyes, triphenylmethane dyes, xanthene dyes, phthalein dyes, polymethine dyes such as oxonol dyes, merocyanine dyes, cyanine dyes, rhodacyanine dyes, styryl dyes, etc. and phthalocyanine dyes which can contain metals, as described in Harumi Miyamoto and Hidehiko Takei "Imaging" No. 8, page 12 (1973), C. Y. Young et al. "RCA Review" 15, 469 (1954), Kohei Kiyota et al. "Denki Tsushin Gakkai Ronbunshi" J63-C (No. 2), 97 (1980), Yuji Harasaki et al. "Kogyo Kagaku Zasshi" 66, 78 and 188 (1963) and Tadaaki Tani "Nippon Shashin Gakkaishi" 35, 208 (1972).

For example, those using carbonium dyes, triphenylmetahe dyes, xanthene dyes or phthalein dyes are described in Japanese Patent Publication No. 452/1976. Japanese Patent Laid-Open Publication Nos. 90334/1975, 114227/1975, 39130/1978, 82353/1978 and 16456/1982 and U.S. Pat. Nos. 3,052,540 and 4,054,450.

As the polymethine dyes such as oxonol dyes, merocyanine dyes, cyanine dyes and rhodacyanine dyes, there can be used dyes described in F. M. Harmmer "The Cyanine Dyes and Related Compounds" and specifically dyes described in U.S. Pat. Nos. 3,047,384, 3,110,591, 3,121,008, 3,125,447, 3,128,179, 3,132,942 and 3,622,317; British Patent Nos. 1,226,892, 1,309,274 and 1,405,898; and Japanese Patent Publication Nos. 7814/1973 and 18892/1980.

The polymethine dyes capable of spectrally sensitizing near infrared radiations to infrared radiations with longer wavelengths of at least 700 nm are described in Japanese Patent Publication No. 41061/1976; Japanese Patent Laid-Open Publication Nos. 840/1972, 44180/1972, 5034/1974, 45122/1974, 46245/1982, 35141/1981, 157254/1982, 26044/1986 and 27551/1986; U.S. Pat. Nos. 3,619,154 and 4,175,956; and "Research Disclosure" 216, pages 117-118 (1982).

The photoreceptor of the present invention is excellent in that its performance is hardly fluctuated even if it is used jointly with various sensitizing dyes. Furthermore, various additives for electrophotographic light-sensitive layers, such as chemical sensitizers, well known in the art can jointly be used as occasion demands, for example, electron accepting compounds such as benzoquinone, chloranil, acid anhydrides, organic carboxylic acids and the like, described in the foregoing "Imaging" No. 8, page 12 (1973) and polyarylalkane compounds, hindered phenol compounds, p-phenylenediamine compounds and the like, described in Hiroshi Komon et al. "Latest Development and Practical Use of Photoconductive Materials and Light-Sensitive Materials (Saikin no Kododenzairyo to Kankotai no Kaihatsu to Jitsuyoka)" Sections 4 to 6, published by Nippon Kagaku Joho Shuppanbu (1986).

The amounts of these additives are not particularly limited, but are generally 0.0001 to 2.0 parts by weight based on 100 parts by weight of the photoconductive materials.

The thickness of the photoconductive layer is generally 1 to 100 μm, preferably 10 to 50 μm.

When in a photoreceptor of laminate type consisting of a charge generating layer and charge transporting layer, a photoconductive layer is used as the charge producing layer, the thickness of the charge producing layer is generally 0.01 to 1 μm, preferably 0.05 to 0.5 μm.

As the charge transporting material of the laminate type photoreceptor, there are preferably used polyvinylcarbazole, oxazole, dyes, pyrazoline dyes, triphenylmethane dyes and the like. The charge transporting layer has generally a thickness of 5 to 40 μm, preferably 10 to 30 μm.

Typical examples of the resin used for forming the charge transporting layer are thermoplastic resins and thermosetting resins such as polystyrene resins, polyester resins, cellulose resins, polyether resins, vinyl chloride resins, vinyl acetate resins, vinyl chloride-vinyl acetate copolymer resins, polyacrylic resins, polyolefin resins, urethane resins, polyester resins, epoxy resins, melamine resins and silicone resins.

The photoconductive layer of the present invention can be provided on a support as well known in the art. Generally, a support for an electrophotographic light-sensitive layer is preferably electroconductive and as the electroconductive support, there can be used, as known in the art, metals or substrates such as papers, plastic sheets, etc. which are made electroconductive by impregnating low resistance materials therein, substrates whose back surface, opposite to the surface to be provided with a light-sensitive layer, is made electroconductive, which is further coated with at least one layer for the purpose of preventing it from curling; the above described support provided with, on the surface thereof, a water proof adhesive layer; the above described support optionally provided with, on the surface layer, one or more pre-coat layer; and papers laminated with plastics which are made electroconductive, for example, by vapor deposition of Al or the like thereon. Examples of the substrates or materials which are electroconductive or made electroconductive are described in Yukio Sakamoto "Electrophotography (Denshi Shashin)" 14 (No. 1), pages 2 to 11 (1975), Hiroyuki Moriga "Introduction to Chemistry of Special Papers (Nyumon Tokushush no Kagaku)" Kobunshi Kankokai (1975), M. F. Hoover "J. Macromol. Sci. Chem." A-4 (6), pp. 1327–1417 (1970), etc.

Preparation of the lithographic printing plate precursor of the present invention can be carried out in conventional manner by dissolving or dispersing the resin of the present invention optionally with the foregoing additives in a volatile hydrocarbon solvent having a boiling point of 200° C. or lower, and coating an electroconductive substrate therewith, followed by drying, to form an electrophotographic light-sensitive layer (photoconductive layer). As the organic solvent, there can preferably be used halogenated hydrocarbons containing 1 to 3 carbon atoms, such as dichloromethane, chloroform, 1,2-dichloroethane, tetrachloroethane, dichloropropane, trichloroethane and the like. In addition, various solvents for coating compositions can further be used, for example, aromatic hydrocarbons such as chlorobenzene, toluene, xylene, benzene and the like, ketones such as acetone, 2-batanone and the like, ethers such as tetrahydrofuran and the like, and methylene chloride;! individually or in combination.

Production of a lithographic printing plate using the electrophotographic lithographic printing plate precursor of the present invention can be carried out in known manner by forming a copying image on the plate having the above described constructions and then subjecting the non-image area to an oil-desensitization processing. This oil-desensitization processing is carried out by effecting an oil-desensitization reaction of, zinc oxide according to the prior art method.

In the method for the oil-desensitization of zinc oxide, there can be used any of known processing solutions, for example, containing, as a predominant component, ferrocyanide compounds as described in Japanese Patent Publication Nos. 7334/1965, 33683/1970, 21244/1971, 9045/1969, 32681/1972 and 9315/1980, and Japanese Patent Laid-Open Publication Nos. 239158/1987, 292492/1987, 99993/1988, 99994/1988, 107889/1982 and 1102/1977, phytic acid compounds as described in Japanese Patent Publication Nos. 28408/1968 and 24609/1970, and Japanese Patent Laid-Open Publication Nos. 103501/1976, 10003/1979, 83805/1978, 83806/1978, 127002/1978, 44901/1979, 2189/1981, 2796/1982, 20394/1982 and 20729/1984, metal chelate-forming water-soluble polymers as described in Japanese Patent Publication Nos. 9665/1963, 22263/1964, 763/1965, 28404/1968 and 29642/1972, and Japanese Patent Laid-Open Publication Nos. 126302/1977, 134501/1977, 49506/1978, 59502/1978 and 104302/1978, metal complex compounds as described in Japanese Patent Publication Nos. 15313/1980 and 41924/1979 and Japanese Patent Laid-Open Publication No. 104301/1978, and inorganic acid- and organic acid compounds as described in Japanese Patent Publication Nos. 13702/1964, 10308/1965 and 26124/1971 and Japanese Patent Laid-Open Publication Nos. 118501/1976 and 11695/1981.

The processing conditions are preferably a temperature of 15° to 60° C. and an immersing time of 10 seconds to 5 minutes.

The present invention will now be illustrated in greater detail by way of examples, but it should be understood that the present invention is not limited thereto.

EXAMPLES

Preparation Example 1 of Macromonomer: [M-1]

A mixed solution of 95 g of 2,2,2,2',2',2'-hexafluoroisopropyl methacrylate, 5 g of thioglycolic acid and 200 g of toluene was heated at a temperature of 70° C. under a nitrogen stream, to which 1.0 g of azobis(isobutyronitrile) (referred hereinafter to as A.I.B.N.) was then added, followed by reacting for 8 hours. 8 g of glycidyl methacrylate, 1.0 g of N,N-dimethyldodecylamine and 0.5 g of t-butylhydroquinone were then added to the reaction solution and stirred at a temperature of 100° C. for 12 hours. After cooling, the reaction solution was subjected to reprecipitation in 2000 ml of methanol to obtain 82 g of white powder. A polymer [M-1] had a weight average molecular weight (referred to as $\overline{M}w$) of 4000.

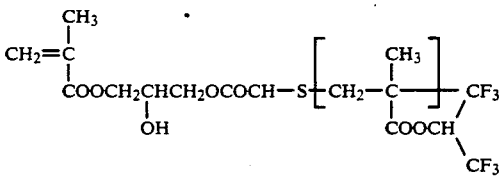

Preparation Example 2 of Macromonomer [M-2]

A mixed solution of 96 g of a monomer (A-1) having the following structure, 4 g of β-mercaptopropionic acid and 200 g of toluene was heated at a temperature of 70° C. under a nitrogen stream, to which 1.0 g of A.I.B.N. was added, followed by reacting for 8 hours. The reaction solution was then cooled to 25° C. in a water bath, to which 10 g of 2-hydroxyethyl methacrylate was added. A mixed solution of 15 g of dicyclohexylcarbonamide (referred to as D.C.C.), 0.2 g of 4-(N,N-dimethylamino)pyridine and 50 g of methylene chloride was dropwise added thereto with agitation for 30 minutes and further stirred for 4 hours. 5 g of formic acid was then added thereto, stirred for 1 hour, the precipitated insoluble material was separated by filtration and the filtrate was subjected to reprecipitation in 1000 ml of n-hexane. The precipitated viscous product was collected by decantation, dissolved in 100 ml of tetrahydrofuran and after separating insoluble materials by filtration, the solution was subjected to reprecipitation in 1000 ml of n-hexane. The viscous precipitate was dried to obtain a polymer [M-2] having an $\overline{M}w$ of $5.2\times10^3$ with a yield of 60 g.

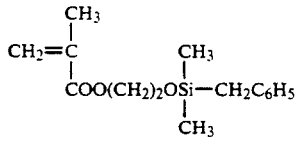

[A-1]

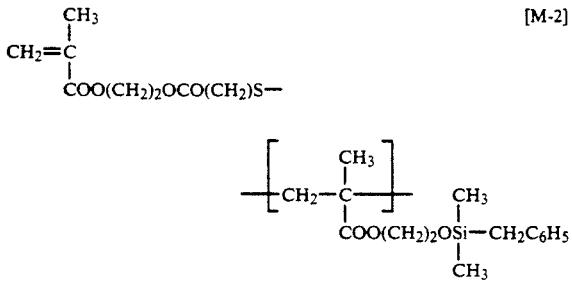

[M-2]

Preparation Example 3 of Macromonomer [M-3]

A mixed solution of 95 g of a monomer (A-2) having the following structure, 150 g of benzotrifluoride and 50 g of ethanol was heated at a temperature of 75° C. under a nitrogen stream with agitation, to which 2 g of 4,4'-azobis(4cyanovaleric acid) (referred to as A.C.V.) was added, followed by reacting for 8 hours. After cooling, the reaction solution was subjected to reprecipitation in 1000 ml of methanol to obtain a polymer, which was dried. 50 g of this polymer and 11 g of 2-hydroxyethyl methacrylate were dissolved in 150 g of benzotrifluoride, the temperature being adjusted to 25° C. To this mixture was dropwise added with agitation a mixed solution of 15 g of D.C.C., 0.1 g of 4-(N,N-dimethylaminopyridine and 30 g of methylene chloride was dropwise added for 30 minutes and further stirred for 4 hours as it was. 3 g of formic acid was then added thereto, stirred for 1 hour, the precipitated insoluble material was separated by filtration and the filtrate was subjected to reprecipitation in 800 ml of n-hexane. The precipitated product was collected, dissolved in 150 g of benzotrifluoride and again subjected to reprecipitation to obtain 30 g of a viscous product, i.e. polymer [M-3] having an $\overline{M}w$ of $3.3\times10^4$.

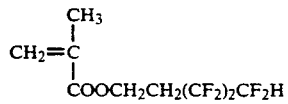

[A-2]

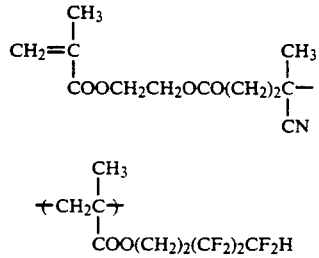

[M-3]

Preparation Examples 4 to 22 of Macromonomers [M-4] to [M-22]

The procedure of Preparation Example 2 was repeated except using other monomers (monomers corresponding to polymeric components described in Table 2) instead of the monomer (A-1) of Preparation Example 2, thus preparing macromonomers [M], each having an $\overline{M}w$ of $4\times10^3$ to $6\times10^3$.

TABLE 2

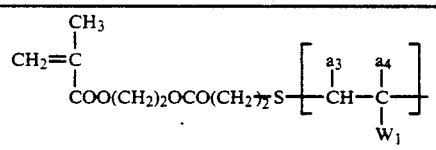

| Preparation Example of Macromonomer | Macromonomer | $a_3$ | $a_4$ | $-W_1$ |
|---|---|---|---|---|
| 4 | [M-4] | H | $CH_3$ | $-COOCH_2CF_3$ |
| 5 | [M-5] | H | $CH_3$ | $-COO(CH_2)_2(CF_2)_4CF_2H$ |
| 6 | [M-6] | H | $CH_3$ | $-COO(CH_2)_2OCOC_3F_7$ |
| 7 | [M-7] | $CH_3$ | H | $-COO(CH_2)_2(CF_2)_6CF_2H$ |
| 8 | [M-8] | H | H | $-COO(CH_2)_2C_4F_9$ |
| 9 | [M-9] | H | $CH_3$ | $-COO(CH_2)_2Si(OCH_3)_3$ |
| 10 | [M-10] | H | $CH_3$ | $-COOSi(C_4H_9)_2CH_2C_6H_5$ |
| 11 | [M-11] | H | H | $-COOCH_2Si(CH_3)_2-O-Si(CH_3)_2-CH_3$ |
| 12 | [M-12] | H | H | $-COO(CH_2)_2NHSO_2C_4F_9$ |
| 13 | [M-13] | H | $CH_3$ | $-COOCH_2CH_2CF_3$ |

TABLE 2-continued

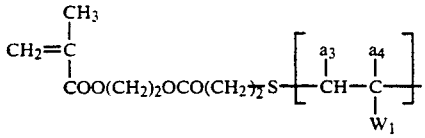

| Preparation Example of Macromonomer | Macromonomer | $a_3$ | $a_4$ | $-W_1$ |
|---|---|---|---|---|
| 14 | [M-14] | H | $CH_3$ | $-COOCH(COOCH_2CF_3)_2$ |
| 15 | [M-15] | H | $CH_3$ | 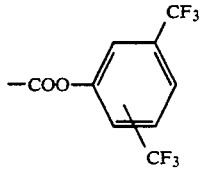 |
| 16 | [M-16] | H | H | 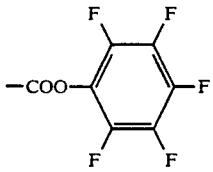 |
| 17 | [M-17] | H | H | $-CH_2OCOC_3H_7$ |
| 18 | [M-18] | H | H | 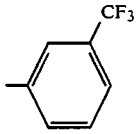 |
| 19 | [M-19] | H | H | 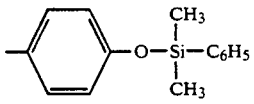 |
| 20 | [M-20] | H | H | $-COOCH_2CH(OCOC_2F_5)CH_2OCOC_2F_5$ |
| 21 | [M-21] | H | $CH_3$ | $-COO(CH_2)_3OSi(C_2H_5)_2CH_2CH_2CF_3$ |
| 22 | [M-22] | $CH_3$ | H | $-COOCH(CF_3)COO(CH_2)_2C(CF_3)_3$ |

Preparation Examples 23 to 30 of Macromonomers [M-23] to [M-30]

The procedure of Preparation Example 2 was repeated except using compounds corresponding to polymers described in Table 3 instead of the monomer (A-1) and 2-hydroxyethyl methacrylate of Preparation Example 2, thus preparing macromonomers [M], each having an Mw of $5\times10^3$ to $6\times10^3$.

TABLE 3

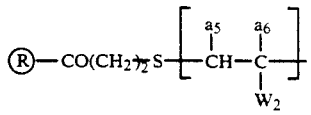

| Preparation Example of Macromonomer | Macromonomer | Ⓡ— | $a_5$ | $a_6$ | $-W_2$ |
|---|---|---|---|---|---|
| 23 | [M-23] | $CH_2=CH$ \| $COO(CH_2)_2O-$ | H | $CH_3$ | $-COOCH_2CH(CF_3)_2$ |
| 24 | [M-24] | $CH_2=CH$ \| $COO(CH_2)_2O-$ | H | $CH_3$ | $-COO(CH_2)_2OSi(C_2H_5)_2CH_2C_6H_5$ |
| 25 | [M-25] | $CH_2=CH$ \| $COO(CH_2)_2O-$ | $CH_3$ | H | $-CH_2COO(CH_2)_2(CF_2)_2CF_2H$ |
| 26 | [M-26] | $CH_2=CH$ \| $CH_2O-$ | H | $CH_3$ | $-COO(CH_2)_3OSi(CH_3)_2-OSi(CH_3)_2-CH_3$ |
| 27 | [M-27] | $CH_2=CH$ \| $COO(CH_2)_2COO(CH_2)_2O-$ | H | $CH_3$ | $-COO(CH_2)_3OSi(CH_3)_2-OSi(CH_3)_2-CH_3$ |
| 28 | [M-28] | $CH_3$ \| $CH=CH_2$ \| $COO(CH_2)_2O-$ | H | H | $-COO(CH_2)_2OCOC_4F_9$ |
| 29 | [M-29] | $CH_2=CH-C_6H_4-CH_2O-$ | H | $CH_3$ | $-COO(CH_2)_2OCOC_4F_9$ |
| 30 | [M-30] | $CH_2=CH$ \| $CONH(CH_2)_2O-$ | H | H | $-COOCH_2CH(OSI(C_2H_5)_3)CH_2OSi(C_2H_5)_3$ |

Preparation Example 1 of Resin Grains: [L-1]

A mixed solution of 20 g of acrylic acid, 5 g of the polymer [M-1] of Preparation Example 1 of Macromonomer and 110 g of methyl ethyl ketone was heated at a temperature of 60° C. under a nitrogen stream. 0.2 g of 2,2'azobis(isovaleronitrile)(referred to as A.B.V.N.) was added thereto and reacted for 2 hours. Further, 0.1 g of A.B.V.N. was added thereto and reacted for 2 hours. The thus resulting dispersion was filtered through a nylon cloth of 200 mesh to obtain resin grains [L-1] with a polymerization ratio of 100% and a mean grain diameter of 0.20 μm (as measured by CAPA 500 -commercial name- manufactured by Horiba Seisakujo KK).

Preparation Example 2 of Resin Grains: [L-2]

Preparation Example 1 of Resin Grains was repeated except using a mixed solution of 20 g of acrylic acid, 5 g of Macromonomer AK-5 (commercial name, commercial available article as a macromonomer of polysiloxane structure manufactured by Toa Gosei KK), 2 g of divinylbenzene and 120 g of methyl ethyl ketone. The resulting dispersion [L-2) had a polymerization ratio of 100% and an average grain diameter of 0.28 μm.

Preparation Examples 3 to 26 of Resin Grains: [L-3] to [L-26]

Preparation Example 1 of Resin Grains was repeated except using a mixed solution of 20 g of monomers (A), 4 g of macromonomers [M] and 150 g of organic solvents as shown in Table 4 to prepare dispersed resin grains each having a polymerization ratio of 95 to 100%.

TABLE 4

| Preparation Example of Resin Grains | Resin Grains [L] | Monomer (A) | Macromonomer [M] | Organic Solvents | Mean Grain Diameter |
|---|---|---|---|---|---|
| 3 | [L-3] | Acrylic acid | [M-3] | Methyl Ethyl Ketone | 0.20 μm |
| 4 | [L-4] | Acrylic acid | [M-5] | Methyl Ethyl Ketone | 0.18 μm |
| 5 | [L-5] | Acrylic acid | [M-8] | Methyl Ethyl Ketone | 0.20 μm |
| 6 | [L-6] | Acrylic acid | [M-9] | Methyl Ethyl Ketone | 0.22 μm |
| 7 | [L-7] | Acrylic acid | [M-11] | Methyl Ethyl Ketone | 0.21 μm |
| 8 | [L-8] | Acrylamide | [AK-5]* | Methyl Ethyl Ketone | 0.15 μm |
| 9 | [L-9] | 2-Hydroxyethyl Methacrylate | [M-13] | Ethyl Acetate 6:n-Hexane 1 | 0.25 μm |
| 10 | [L-10] | 2,3-Dihydroxylpropyl Methacrylate | [FM-721]** | Methyl Isopropyl Ketone | 0.35 μm |
| 11 | [L-11] | 2-Phosphonoethyl Methacrylate | [M-5] | Methyl Ethyl Ketone | 0.12 μm |
| 12 | [L-12] | 1-Vinylpyrrolidone | [M-5] | Methyl Ethyl Ketone | |
| 13 | [L-13] | 1-Vinylimidazole | [AK-5] | Methyl-Isobutyl Ketone | 0.10 μm |
| 14 | [L-14] | Acrolein | [M-5] | n-Hexane 9:Ethyl Acetate 1 | 0.15 μm |
| 15 | [L-15] | Crotonic Acid | [AK-5] | Methyl Ethyl Ketone | 0.25 μm |
| 16 | [L-16] | Methacrylic Acid | [M-23] | Methyl Ethyl Ketone | 0.45 μm |
| 17 | [L-17] | 2-(N-morpholino)ethyl Methacrylate | [AK-5] | Methyl Ethyl Ketone | 0.18 μm |
| 18 | [L-18] | 2-Hydroxyethyl Acrylate | [AK-5] | Methyl Ethyl Ketone | 0.20 μm |
| 19 | [L-19] | 2-Phosphonoethyl Acrylate | [M-28] | Methyl Ethyl Ketone | 0.25 μm |
| 20 | [L-20] | 2-Carboxyethyl Acrylate | [M-25] | Methyl Isobutyl Ketone | 0.30 μm |
| 21 | [L-21] | Methacrolein | [M-26] | Methyl Ethyl Ketone | 0.28 μm |
| 22 | [L-22] | 4-Vinylpyridine | [M-28] | Methyl Ethyl Ketone | 0.20 μm |
| 23 | [L-23] | Allyl Alcohol | [M-26] | Methyl Ethyl Ketone | 0.43 μm |
| 24 | [L-24] | Acrylic Acid | [AK-5] | Methyl Ethyl Ketone | 0.20 μm |
| 25 | [L-25] | Acrylamide | [M-5] | Methyl Ethyl Ketone | 0.18 μm |
| 26 | [L-26] | 4-Vinylphenol | [M-7] | Methyl n-Propyl Ketone | 0.30 μm |

Note:
*Macromonomer made by Toa Gosei KK
**Macromonomer made by Nippon Yushi KK

Preparation Examples 27 to 37 of Resin Grains: [L-27] to [L-37]

Preparation Example 2 of Resin Grains was repeated except using multifunctional compounds show in the following Table 5 instead of 2 g of the divinylbenzene to prepare resin grains, each having a polymerization ratio of 100% and an average grain diameter of 0.25 to 0.35 μm.

TABLE 5

| Preparation Example of Resin Grains | Resin Grains [L] | Multifunctional Compounds | Amount |
|---|---|---|---|
| 27 | [L-27] | Ethylene Glycol Dimethacrylate | 1 g |
| 28 | [L-28] | Ethylene Glycol Dimethacrylate | 2 g |
| 29 | [L-29] | Diethylene Glycol Dimethacrylate | 2.5 g |
| 30 | [L-30] | Trivinylbenzene | 1.2 g |
| 31 | [L-31] | Ethylene Glycol Diacrylate | 1.5 g |
| 32 | [L-32] | Propylene Glycol Dimethacrylate | 2.2 g |
| 33 | [L-33] | Propylene Glycol Diacrylate | 2.0 g |
| 34 | [L-34] | Vinyl Methacrylate | 3 g |
| 35 | [L-35] | Allyl Methacrylate | 3 g |
| 36 | [L-36] | Trimethylolpropane Trimethacrylate | 1.3 g |
| 37 | [L-37] | Isopropenyl Itaconate | 2.2 g |

Preparation Example 1 of Dispersion Stabilizing Resin: [P-1]

A mixed solution of 97 g of dodecyl methacrylate, 3 g of glycidyl methacrylate and 200 g of toluene was heated at a temperature of 75° C. under a nitrogen stream while stirring. 1.0 g of A.I.B.N. was added thereto, followed by stirring for 4 hours, and 0.5 g of A.I.B.N. was further added thereto, followed by stirring for 4 hours. To this reaction mixture were added 5 g of methacrylic acid, 1.0 g of N,N-dimethyldodecylamine and 0.5 g of butylhydroquinone and stirred at temperature of 110° C. for 8 hours. After cooling, the product was subjected to reprecipitation in 2000 ml of methanol, a brownish oily product was collected and dried to obtain a polymer with a yield of 73 g and a weight average molecular weight (Mw) of $3.6\times10^4$:

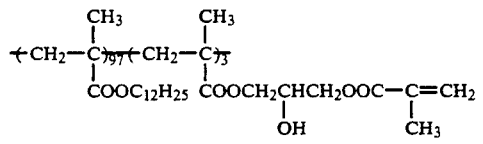

]P-1]

Preparation Example 2 of Dispersion Stabilizing Resin: [P-2]

A mixed solution of 100 g of 2-ethylhexyl methacrylate, 150 g of toluene and 50 g of isopropanol was heated at a temperature of 75° C. under a nitrogen stream while stirring. 2 g of A.C.V was added thereto, followed by reacting for 4 hours, and 0.8 g of A.C.V was further added thereto, followed by reacting for 4 hours. After cooling, the product was subjected to reprecipitation in 2000 ml of methanol and the resulting oily product was collected and dried.

A mixture of 50 g of the resulting oily product, 6 g of 2-hydroxyettiyl methacrylate and 150 g of tetrahydrofuran was dissolved, to which a mixed solution of 8 g of dicyclohexylcarbondiimide (D.C.C.), 0.2 g of 4-(N,N-dimethylamino)pyridine and 20 g of methylene chloride was dropwise added at a temperature of 25° to 30° C., followed by further stirring as it was for 4 hours. 5 g of formic acid was then added to this reaction mixture and stirred for 1 hour. The precipitated insoluble material was separated by filtration and the filtrate was reprecipitated in 1000 ml of methanol to collect an oily product, which was then dried. 32 g of a polymer was obtained having an Mw of $4.2\times10^4$.

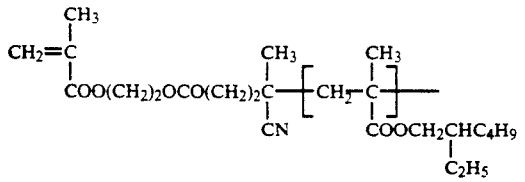

[P-2]

Preparation Example 3 of Dispersion Stabilizing Resin: [P-3]

A mixed solution of 96 g of butyl methacrylate, 4 g of thioglycolic acid and 200 g of toluene was heated at a temperature of 70° C. under a nitrogen stream while stirring. 1.0 g of A.I.B.N. was added thereto, followed by reacting for 8 hours. To this reaction solution were added 8 g of glycidyl methacrylate, 1.0 g of N,N-dimethyldodecylamine and 0.5 g of t-butylhydroquinone and stirred at temperature of 100° C. for 12 hours. After cooling, the reaction solution was subjected to reprecipitation in 2000 ml of methanol and 82 g of an oily product was collected to obtain a polymer with a number average molecular weight of 5600.

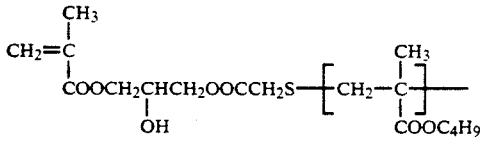

[P-3]

Preparation Example 38 of Resin Grains: [L-38]

A mixed solution of 47.5 g of acrylic acid, 2.5 g of 2,2,2,2',2',2'-hexafluoroisopropyl methacrylate, 7.5 g of the resin [P-1] of Preparation Example 1 of Dispersing Stabilizing Resin and 275.8 g of methyl ethyl ketone was heated at a temperature of 65° C. under a nitrogen stream while stirring. 0.5 g of A.B.V.N. was added thereto and reacted for 2 hours. Further, 0.25 g of A.B.V.N. was added thereto and reacted for 2 hours. After cooling, the thus resulting dispersion was filtered through a nylon cloth of 200 mesh to obtain a white dispersion [L-38], i.e. latex with a polymerization ratio of 100% and a mean grain diameter of 0.38 μm.

Preparation Example 39 of Resin Grains: [L-39]

A mixed solution of 7.5 g of the dispersion stabilizing resin AA-2 (macromonomer manufactured by Toa Gosei KK, comprising recurring units of methyl methacrylate; Mw: $3\times10^3$) and 133 g of methyl ethyl ketone was heated at a temperature of 65° C. under a nitrogen stream while stirring.

A mixed solution of 47.5 g of acrylic acid, 2.5 g of 2,2,2-trifluoroethyl methacrylate [Monomer (B-2)], 0.5 g of A.B.V.N. and 150 g of methyl ethyl ketone was dropwise added thereto for 1 hour and stirred as it was for 1 hour. Further, 0.25 g of A.B.V.N. was added thereto and reacted for 2 hours. After cooling, the thus resulting dispersion was filtered through a nylon cloth of 200 mesh to obtain a white dispersion [L-39] with a polymerization ratio of 100% and a mean grain diameter of 0.19 μm.

Preparation Examples 40 to 53 of Resin Grains: [L-40] to [L-53]

Preparation Example 39 was repeated except using 2.5 g of each of monomers shown in the following Table 6 [(B-3) to (B-16)] instead of 2.5 g of 2,2,2'trifluoroethyl methacrylate, thus obtaining a white dispersion, i.e. latex [L-40]to [L-53] with a polymerization ratio of 100% and a mean grain diameter of 0.15 to 0.23 μm.

TABLE 6

| Preparation Example of Resin Grains | Resin Grains [L] | Monomer (B) |
|---|---|---|
| 3 | [L-3] | $CH_2{=}CH(COOCH_2CF_3)$ (B-3) |
| 4 | [L-4] | $CH_2{=}CH(COOCH(CF_3)_2)$ (B-4) |
| 5 | [L-5] | $CH_2{=}C(CH_3)(COOCH_2CF_2CFHCF_3)$ (B-5) |
| 6 | [L-6] | $CH_2{=}C(CH_3)(COOCH_2CF_2CF_2HCF_3)$ (B-6) |
| 7 | [L-7] | $CH_2{=}C(CH_3)(COOCH(CF_3)_2)$ (B-7) |
| 8 | [L-8] | $CH_2{=}C(CH_3)(COOCH_2CH_2C_8F_{17})$ (B-8) |
| 9 | [L-9] | $CH_2{=}CH(COOCH_2CH_2C_8F_{17})$ (B-9) |
| 10 | [L-10] | $CH_2{=}C(CH_3)(COOCH_2OSi(CH_3)_3)$ (B-10) |
| 11 | [L-11] | $CH_2{=}C(CH_3)(COO(CH_2)_3Si(CH_3)_2-O-Si(CH_3)_2-CH_3)$ (B-11) |

TABLE 6-continued

| Preparation Example of Resin Grains | Resin Grains [L] | Monomer (B) |
|---|---|---|
| 12 | [L-12] | $CH_2=C(CH_3)-COOCH_2CH_2COOCH_2CF_2CF_2HCF_3$ (B-12) |
| 13 | [L-13] | $CH_2=CH-COO(CH_2)_2OSi(CH_3)_2C_4H_9$ (B-13) |
| 14 | [L-14] | $CH_2=CH-COO(CH_2)_2OSi(CF_3)_2C_4H_9$ (B-14) |
| 15 | [L-15] | $CH_2=C(CH_3)-COO(CH_2)_3SO_2NHC_8F_{17}$ (B-15) |
| 16 | [L-16] | $CH_2=CH-COOCH_2CH_2C_nF_{2n+1}$ n = 8~10 (B-16) |

TABLE 7-continued

| Preparation Example of Resin Grains | [L] | Monomer (A) |
|---|---|---|
| 56 | [L-56] | $CH_2=C(CH_3)-COO(CH_2)_2OH$ |
| 57 | [L-57] | $CH_2=C(CH_3)-COO(CH_2)_2O-P(=O)(OH)-OH$ |
| 58 | [L-58] | 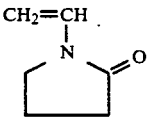 |
| 59 | [L-59] | $CH_2=CH-CHO$ |
| 60 | [L-60] | $CH_2=CH-C\equiv N$ |
| 61 | [L-61] | $CH_2=C(CH_3)-COOH$ 70 : $CH_2=C(CH_3)-COOCH_3$ 30 (weight ratio) |

Preparation Examples 54 to 61 of Resin Grains: [L-54] to [L-61]

A mixed solution of 7.5 g of the dispersion stabilizing resin AB-6 (macromonomer manufactured by Toa Gosei KK, comprising recurring units of n-butyl acrylate: MW: $1\times10^4$) and 133 g of methyl ethyl ketone was heated at a temperature of 65° C. under a nitrogen stream while stirring.

A mixed solution of 48.5 g of monomers (A) shown in Table 7, 1.5 g of the foregoing monomer (B-6), 0.5 g of A.B.V.N. and 150 g of methyl ethyl ketone was dropwise added thereto for 1 hour and stirred as it was for 1 hour. Further, 0.25 g of A.B.V.N. was added thereto and stirred for 2 hours. After cooling, the thus resulting dispersion was filtered through a nylon cloth of 200 mesh to obtain white dispersion [L-54] to [L-61] being latexes each having a polymerization ratio of 100% and a mean grain diameter of 0.13 to 0.25 μm.

TABLE 7

| Preparation Example of Resin Grains | [L] | Monomer (A) |
|---|---|---|
| 54 | [L-54] | $CH_2=CH-CONH_2$ |
| 55 | [L-55] | $CH_2=CH-COO(CH_2)_2OH$ |

Preparation Example 62 of Resin Grains: [L-62]

Preparation Example 38 of Resin Grains was repeated except using a mixed solution of 47.5 g of acrylic acid, 2.5 g of the monomer (B-4), 1 g of ethylene glycol dimethacrylate, 7 g of the resin [P-3] in Preparation Example 3 of Dispersing Stabilizing Resin and 27.5 g of diethyl ketone, to obtain a white dispersion [L-62] having a polymerization ratio of 100% and an average grain diameter of 0.18 μm.

Preparation Examples 63 to 73 of Resin Grains: [L-63] to [L-73]

Preparation Example 62 of Resin Grains was repeated except using multi-functional compounds shown in Table 8 in place of 1 g of ethylene glycol dimethacrylate to prepare resin grains [L-63] to [L-73] each having a polymerization ratio of 100% and an average grain diameter of 0.18 to 0.23 μm.

TABLE 8

| Preparation Example of Resin Grains | Resin Grain [L] | Multifunctional Compounds | Amount |
|---|---|---|---|
| 63 | [L-63] | Ethylene Glycol Dimethacrylate | 0.5 g |
| 64 | [L-64] | Divinylbenzene | 1 g |
| 65 | [L-65] | Diethyl Glycol Dimethacrylate | 1.25 g |
| 66 | [L-66] | Trivinylbenzene | 0.6 g |
| 67 | [L-67] | Ethylene Glycol Diacrylate | 0.8 g |
| 68 | [L-68] | Propylene Glycol Dimethacrylate | 1.1 g |
| 69 | [L-69] | Propylene Glycol Diacrylate | 1.0 g |
| 70 | [L-70] | Vinyl Methacrylate | 1.5 g |

TABLE 8-continued

| Preparation Example of Resin Grains | Resin Grain [L] | Multifunctional Compounds | Amount |
|---|---|---|---|
| 71 | [L-71] | Allyl Methacrylate | 1.5 g |
| 72 | [L-72] | Trimethylolpropane Trimethacrylate | 0.8 g |
| 73 | [L-73] | Isopropenyl Itaconate | 1.0 g |

EXAMPLE 1 AND COMPARATIVE EXAMPLES A AND B

Example 1

A mixture of 40 g of a binder resin [BR-1] having the following structure, 200 g of photoconductive zinc oxide, 0.03 g of uranine, 0.06 g of Rose Bengal, 0.02 g of tetrabromophenol blue, 0.20 g of maleic anhydride and 300 g of toluene was ball milled for 4 hours. 0.2 g (as solid) of the dispersed resin grains [L-1] was added to prepare a light-sensitive layer forming dispersion, which was then applied to a paper rendered electrically conductive to give a dry coverage of 20 g/m$^2$ by a wire bar coater, followed by drying at 100° C. for 3 minutes. The thus coated paper was allowed to stand in a dark place at a temperature of 20° C. and a relative humidity of 65% for 24 hours to prepare an electrophotographic light-sensitive material.

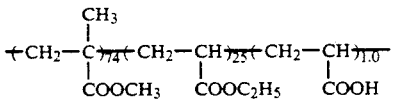

[BR-1]

$\overline{M}w$: 5.3 × 10$^4$ (weight ratio)

Comparative Example A

Example 1 was repeated except omitting 2.0 g of the dispersed resin grains [L-1] to prepare an electrophotographic light-sensitive material.

Comparative Example B

Preparation of Comparative Resin Grains: [LR-1]

A mixed solution of 20 g of acrylic acid, 5 g of a macromonomer [MR-1] having the following structure and 110 g of methyl ethyl ketone was prepared and then subjected to the similar processing to Preparation Example 1 of Resin Grains to prepare resin grains [LR-1] with a polymerization ratio of 100% and an average grain diameter of 0.23 μm.

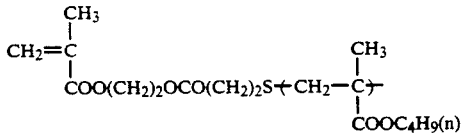

[MR-1]

$\overline{M}w$: 6 × 10$^3$

Preparation of Comparative Photoreceptor

Example 1 was repeated except using 0.2 g (as solid) of the above described resin grains [LR-1] instead of 2.0 g of the resin grains [L-1] to prepare a photoreceptor.

These light-sensitive materials were subjected to estimation of the film property (smoothness of surface), electrostatic properties, oil-desensitivity a photoconductive layer in terms of the contact angle of the photoconductive layer after an oil-desensitizing processing with water and printing performance. The printing performance was examined by subjecting the light-sensitive material to exposing and developing processings using an automatic printing plate making machine ELP 404 V (commercial name, manufactured by Fuji Photo Film Co., Ltd.) and a developing agent ELP-T to form a toner image and then to oil-desensitization. The resulting lithographic printing plate was mounted on an offset printing machine (Hamada Star 800 SX -commercial name-, manufactured by Hamada Star KK) and subjected to printing.

The results are shown in Table 9.

TABLE 9

| | | Example 1 | Comparative Examples A | Comparative Examples B |
|---|---|---|---|---|
| Smoothness of Photoconductive Layer (sec/cc)[1] | | 450 | 460 | 450 |
| Electrostatic Characteristics[2] | | | | |
| $V_{10}$ (−V) | I (20° C., 65% RH) | 560 | 560 | 560 |
| | II (30° C., 80% RH) | 540 | 540 | 540 |
| D.R.R. (%) | I (20° C., 65% RH) | 89 | 89 | 89 |
| | II (30° C., 80% RH) | 85 | 85 | 85 |
| $E_{1/10}$ (lux · sec) | I (20° C., 65% RH) | 13.0 | 13.5 | 13.4 |
| | II (30° C., 80% RH) | 14.5 | 15.0 | 15.0 |
| $E_{1/100}$ (lux · sec) | I (20° C., 65% RH) | 40 | 40 | 40 |
| | II (30° C., 80% RH) | 43 | 45 | 44 |
| Image Quality[3] | I (20° C., 65% RH) | ○ good | ○ good | ○ good |
| | II (30° C., 80% RH) | ○ good | ○ good | ○ good |
| Water Retention[4] | | ◎ very good | XX remarkable background staining | XX remarkable background staining |
| Background Staining of Print[5] | | no background stain up to 6000 prints | background staining from start | background staining from start |

The characteristic items described in Table 9 were evaluated as follows:

1) Smoothness of Photoconductive Layer

The resulting light-sensitive material was subjected to measurement of its smoothness (sec/cc) under an air volume of 1 cc using a Beck smoothness tester (manufactured by Kumagaya Riko KK).

2) Electrostatic Characteristics

Each of the light-sensitive materials was subjected to corona discharge at a voltage of −6 kV for 20 seconds in a dark room at a temperature of 20° C. and relative humidity of 65% using a paper analyzer (Paper Analyzer SP-428 -commercial name- manufactured by Kawaguchi Denki KK) and after allowed to stand for 10 seconds, the surface potential $V_{10}$ was measured. The, the sample was further allowed to stand in the dark room as it was for 60 seconds to measure the surface potential $V_{70}$, thus obtaining the retention of potential after the dark decay for 60 seconds, i.e., dark decay retention ratio (DRR (%)) represented by $(V_{70}/V_{10})\times 100$ (%). Moreover, the surface of the photoconductive layer was negatively charged to −400 V, by corona discharge, then irradiated with a visible ray of an illuminance of 2.0 lux and the time required for dark decay of the surface potential ($V_{10}$ to 1/10 was measured to evaluate the exposure quantity $E_{1/10}$ (lux sec). Similarly, the time required for the decay of $V_{10}$ to 1/100 was measured to evaluate the exposure quantity $E_{1/100}$ (lux.sec).

3) Image Quality

Each of the light-sensitive materials and an automatic printing plate making machine ELP 404 V were allowed to stand for a whole day and night at normal temperature and normal humidity (20° C., 65%) and then subjected to plate making and forming a reproduced image, which was then visually observed to evaluate the fog and image quality I. The same procedure was repeated except that the plate making was carried out at a high temperature and high humidity (30° C., 80%) to evaluate the image quality II of a reproduced image.

4) Water Retention of Raw Plate

Each of the light-sensitive materials before plate making (precursor not subjected to plate making: referred to as "raw plate") was passed through an etching machine using an oil-desensitizing solution ELP-EX (commercial name, manufactured by Fuji Photo Film Co., Ltd.) diluted by 5 times with distilled water. Then, the sample was subjected to printing using a printing machine (Hamada Star 8005 X -commercial name-manufactured by Hamada Star KK) and subjected to visual estimation of the presence or absence of background staining of the print from the start of printing to 50 prints.

5) Background Staining of Print

Each of the light-sensitive materials was subjected to plate making in the same manner as described in the above item (3), passed once through an etching machine using ELP-EX diluted by 2 times with distilled water, subjected to printing as an offset master and then to examine the number of prints until the background stains can visually be judged.

As can be seen from Table 9, the light-sensitive material of the present invention and Comparative Examples A and B showed good electrostatic characteristics and gave reproduced images clear and excellent in image quality.

When each of these light-sensitive materials was subjected to an oil-desensitizing processing to estimate the degree of rendering hydrophilic on non-image areas, background staining by adhesion of a printing ink was remarkable and the non-image areas were not sufficiently rendered hydrophilic in Comparative Examples A and B.

When the sample was subjected to plate making, then to oil-desensitizing processing and to real printing, the lithographic printing plate of the present invention gave 6000 prints of clear image, free from background stains, while in Comparative Examples A and B, background staining on non-image areas was remarkable from the start of printing.

As described above, according to only the present invention, there can be obtained an electrophotographic lithographic printing plate precursor such that the hydrophilic property on non-image areas can sufficiently proceed and background stains do not occur.

Example 2

Example 1 was repeated except using 5.7 g of a binder resin [BR-2] having the following structure and 32.3 g of another binder resin [BR-3] having the following structure instead of 38 g of the binder resin [BR 1] to prepare an electrophotographic light-sensitive material:

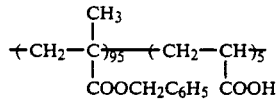

[BR-2]

(weight ratio) $\overline{M}w$: $6.0\times 10^3$

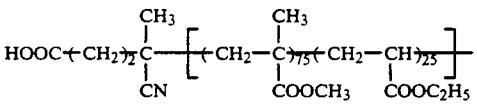

[BR-3]

$\overline{M}w$: $6.5\times 10^3$ (weight ratio)

The various properties were measured in an analogous manner to Example 1. The measured results under severer conditions (30° C., 8% RH) are shown in the following:

| Electrostatic Characteristics | |
|---|---|
| $V_{10}$: | −560 V |
| D.R.R.: | 90% |
| $E_{1/10}$: | 11.3 lux · sec |
| $E_{1/100}$: | 32 lux · sec |
| Image Quality: | very good (◎) |
| Water Retention of Raw Plate: | very good (◎) |
| Background Staining of Print: | no background stains up to 6000 prints |

Each of the light-sensitive materials according to the present invention was excellent in static charge property, dark charge retention and photosensitivity, and a real reproduced image and print gave a clear image without occurrence of background stains even at a high temperature and high humidity (30° C., 80% RH).

Examples 3 to 11

Example 2 was repeated except using 0.5 g (as solid) of resin grains [L] shown in Table 10 of the present invention instead of 0.2 g of the dispersed resin grains in Example 2 to prepare light-sensitive materials.

The electrostatic characteristics and printing property was estimated in an analogous manner to Example 2.

TABLE 10

| Example | Dispersed Resin Grains |
|---|---|
| 3 | [L-8] |
| 4 | [L-9] |
| 5 | [L-10] |
| 6 | [L-11] |
| 7 | [L-12] |
| 8 | [L-13] |
| 9 | [L-14] |
| 10 | [L-15] |
| 11 | [L-16] |

Each of the light-sensitive materials exhibited substantially the similar results in the electrostatic characteristics and image quality to Example 2.

When each of the resulting light-sensitive materials was subjected to oil-desensitizing processing to evaluate the properties of the offset lithographic plate precursor, any material gave a good water retention as a raw plate and printing after plate making gave 6000 prints.

Example 12 and Comparative Examples C and D

A mixture of 6.0 g of a binder resin [BR-5] having the following structure, 34 g of another binder resin [BR-6] having the following structure, 200 g of zinc oxide, 0.018 g of a cyanine dye having the following structure and 300 g of toluene was ball milled for 4 hours. 0.3 g (as solid) of the resin grains [L-28] was added thereto to prepare a light-sensitive layer forming dispersion and further dispersed for 5 minutes, which was then applied to a paper rendered electrically conductive to give a dry coverage of 20 g/m$^2$ by a wire bar coater, followed by drying at 100° C. for 3 minutes. The thus coated paper was allowed to stand in a dark place at a temperature of 20° C. and a relative humidity of 65% for 24 hours to prepare an electrophotographic light-sensitive material.

Resin [BR-5]

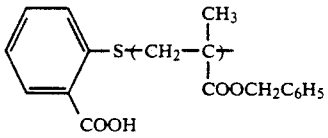

$\overline{M}w$: 6.5 × 10$^3$

Resin [BR-6]

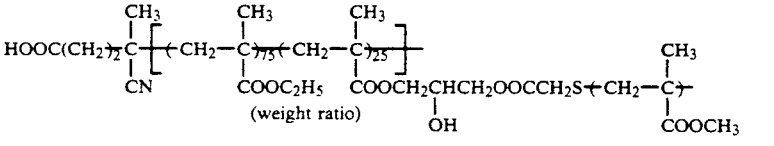

(weight ratio)

$\overline{M}w$: 8 × 10$^4$ (weight ratio)

Cyanine Dye [A]

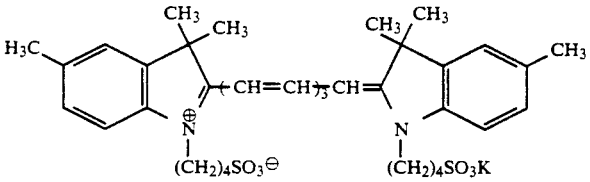

Comparative Example C

Example 12 was repeated except omitting 0.3 g of the resin grains [L-28] to prepare an electrophotographic light-sensitive material.

Comparative Example D

Example 12 was repeated except using 3 g of the resin grains [LR-1] instead of 0.3 g of the resin grains L-12] to prepare an electrophotographic light-sensitive material.

These light-sensitive materials were subjected to estimation of the film property (smoothness of surface), film strength, electrostatic characteristics, image quality and electrostatic characteristics and image quality under ambient conditions of 30° C. and 80% RH. Furthermore, when using these light-sensitive materials as an offset master, the oil-desensitivity of the photoconductive layer (water retention) and the printing property (background stains, printing durability) were examined.

The results are shown in Table 11.

TABLE 11

| | | Example 12 | Comparative Examples C | Comparative Examples D |
|---|---|---|---|---|
| Smoothness of Photoconductive Layer (sec/cc) | | 400 | 400 | 450 |
| Electrostatic Characteristics[6)] | | | | |
| $V_{10}$ (−V) | I (20° C., 65% RH) | 560 | 570 | 500 |
| | II (30° C., 80% RH) | 550 | 560 | 400 |
| D.R.R. (%) | I (20° C., 65% RH) | 88 | 89 | 75 |
| | II (30° C., 80% RH) | 85 | 86 | 65 |
| $E_{1/10}$ (lux/sec) | I (20° C., 65% RH) | 25 | 29 | 45 |
| | II (30° C., 80% RH) | 26 | 33 | 54 |
| $E_{1/100}$ (lux/sec) | I (20° C., 65% RH) | 52 | 57 | 86 |

TABLE 11-continued

| | | Example 12 | Comparative Examples C | Comparative Examples D |
|---|---|---|---|---|
| | II (30° C., 80% RH) | 53 | 54 | 98 |
| Image Quality[7)] | I (20° C., 65% RH) | ○ good | ○ good | Δ~○ $D_M$ tending to lower, slight background stains |
| | II (30° C., 80% RH) | ○ good | ○ good | .X occurrence of background stains and disappearance of letters, fine lines |
| Water Retention of Raw Plate | | ◎ very good, no background stains | XX remarkable background staining | ○ no background stains |
| Background Staining of Print | | ◎ no background stain up to 6000 | XX background staining from start | XX background staining from start disappearance of letters, fine lines |

The Characteristic items described in Table 11 were evaluated in an analogous manner to Example 1 as to the smoothness of the photoconductive layer and the background staining of the print, but the other properties were according to the following procedures:

6) Electrostatic Characteristics

Each of the light-sensitive materials was subjected to corona discharge at a voltage of −6 kV for seconds in a dark room at a temperature of 20° C. and relative humidity of 65% using a paper analyzer (Paper Analyzer SP-428 -commercial name- manufactured by Kawaguchi Denki KK) and after allowed to stand for 10 the surface potential $V_{10}$ was measured. Then, the sample was further allowed to stand in the dark room as it was for 180 seconds to measure the surface potential $V_{190}$, thus obtaining the retention of potential after the dark decay for 180 seconds, i.e., dark decay retention ratio (DRR (%)) represented by $(V_{190}/V_{10})\times 100$ (%). Moreover, the surface of the photoconductive layer was negatively charged to −400 V, by corona discharge, then irradiated with monochromatic light of a wavelength of 780 nm and the time required for dark decay of the surface potential ($V_{10}$) to 1/10 was measured to evaluate and exposure quantity $E_{1/10}$ (erg/cm$^2$). Similarly, the time required for the decay of the surface potential ($V_{10}$) to 1/100 was measured to evaluate the exposure quantity $E_{1/100}$ (erg/cm$^2$).

The ambient conditions for the measurement of the electrostatic characteristics were:

I . . . 20° C., 65% RH

II . . . 30° C., 85% RH

7) Image Quality

Each of the light-sensitive materials was allowed to stand for a whole day and night under the following ambient conditions, charged at −5 kV, image-wise exposed rapidly at a pitch of 25 μm and a scanning speed of 330 m/sec under irradiation of 45 erg/cm$^2$ on the surface of the light-sensitive material using a gallium-aluminum-arsenic semiconductor laser (oscillation wavelength: 780 nm) with an output of 2.0 mW as a light source, developed with a liquid developer, ELP-T (-commercial name- manufactured by Fuji Photo Film Co., Ltd.) and fixed to obtain a reproduced image which was then subjected to visual evaluation of the fog and image quality:

I . . . 20° C., 65% RH

II . . . 30° C., 80% RH

As can be seen from Table 11, the light-sensitive materials of the present invention and Comparative Example C showed excellent electrostatic characteristics and image quality.

In Comparative Example D, on the other hand, the electrostatic characteristics were lowered and largely affected, in particular, when the ambient conditions were fluctuated and in real copied images, there occurred background stains and disappearance of letters and fine lines.

Further, in the precursors having been subjected to an oil-desensitizing processing, only that of the present invention was sufficiently rendered hydrophilic and could give 6000 prints without adhesion of ink, while that of Comparative Example C was not sufficiently rendered hydrophilic and that of Comparative Example D exhibited a sufficient water retention of raw plate, but only gave insufficient prints from the start of printing because of deterioration of a reproduced image in a precursor after really plate making.

Examples 13 to 18

Example 12 was repeated except using respectively 2 g of resin grains [L]shown in Table 12 in place of 2 g of the binder resin grains [L-28], thus obtaining light sensitive materials.

TABLE 12

| Example | Resin Grains [L] | Electrostatic Characteristics (30° C., 80% RH) $V_{10}$ (−V) | D.R.R. (%) | $E_{1/10}$ (erg/cm$^2$) | $E_{1/100}$ (erg/cm$^2$) | Image Quality (30° C., 80% RH) | Water Retention of Raw Plate |
|---|---|---|---|---|---|---|---|
| 13 | [L-29] | 555 | 85 | 27 | 55 | ◎ Very Good | ◎ No Background Stains |
| 14 | [L-35] | 555 | 86 | 26 | 53 | ◎ Very Good | ◎ No Background Stains |
| 15 | [L-8] | 550 | 86 | 24 | 54 | ◎ Very Good | ◎ No Background Stains |
| 16 | [L-10] | 545 | 85 | 27 | 56 | ◎ Very Good | ◎ No Background Stains |
| 17 | [L-11] | 550 | 86 | 28 | 57 | ◎ Very Good | ◎ No Background Stains |
| 18 | [L-12] | 555 | 87 | 26 | 55 | ◎ Very Good | ◎ No Background Stains |

As shown in Table 12, according to the present invention, there were obtained excellent electrostatic characteristics at not only normal temperature and normal humidity (20° C., 65% RH) but also high temperature and high humidity (30° C., 80% RH). Furthermore, the light-sensitive material of the present invention exhibited good image quality and water retention. When using it as a master plate for offset printing, 6000 or more prints with a clear image quality were obtained without background staining.

Examples 19 to 26

A mixture of 6.0 g of a binder resin [BR-7] having the following structure, 34 g of another binder resin [BR-8] having the following structure, 200 g of photoconductive zinc oxide, 0.20 g of phthalic anhydride, 0.018 g of a cyanine dye having the following structure and 300 g of toluene was ball milled for 4 hours. 0.3 g (as solid) of resin grains shown in the following Table 13 was then added thereto and further dispersed for 5 minutes, which was then applied to a paper rendered electrically conductive to give a dry coverage of 20 g/m$^2$ by a wire bar coater, followed by drying at 100° C. for 3 minutes. The thus coated paper was allowed to stand in a dark place at a temperature of 20° C. and a relative humidity of 65% for 24 hours to prepare an electrophotographic light-sensitive material.

Resin [BR-7]

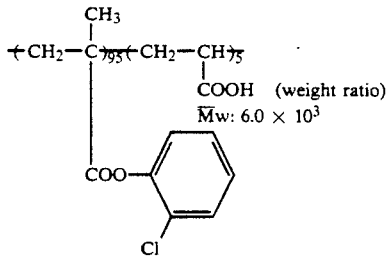

Resin [BR-8]

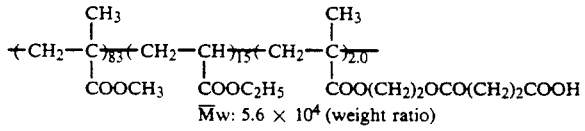

Cyanine Dye [B]

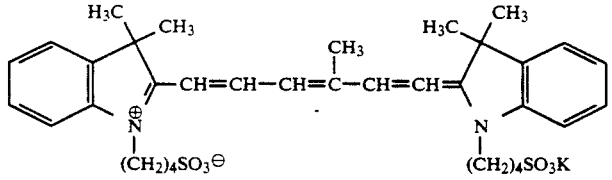

TABLE 13

| Example | Resin Grains |
|---|---|
| 19 | [L-5] |
| 20 | [L-6] |
| 21 | [L-10] |
| 22 | [L-12] |
| 23 | [L-13] |
| 24 | [L-15] |
| 25 | [L-30] |
| 26 | [L-25] |

When each of the light-sensitive materials prepared in Examples 19 to 26 was subjected to measurement of the electrostatic characteristics and printing property in an analogous manner to Example 12, all the samples were excellent in electrification property, dark charge retention and photosensitivity and really reproduced image gave a clear image free from occurrence of background stains and disappearance of fine lines even under severer conditions, e.g., high temperature and high humidity (30° C., 80% RH). When printing was carried out using it as a master plate for offset printing, at least 500 to 8000 sheets of clear images were obtained without occurrence of background stains on non-image areas.

EXAMPLE 27 AND COMPARATIVE EXAMPLES E AND F

Example 27

A mixture of 40 g of the binder resin [BR-1], 200 g of photoconductive zinc oxide, 0.03 g of uranine, 0.06 g of Rose Bengal, 0.02 g of tetrabromophenol blue, 0.20 g of maleic anhydride and 300 g of toluene was ball milled for 4 hours. 0.8 g (as solid) of the dispersed resin grains [L-39] was added to prepare a light-sensitive layer forming dispersion, which was then applied to a paper rendered electrically conductive to give a dry coverage of 20 g/m$^2$ by a wire bar coater, followed by drying at 100° C. for 3 minutes. The thus coated paper was allowed to stand in a dark place at a temperature of 20° C. and a relative humidity of 65% for 24 hours to prepare an electrophotographic light-sensitive material.

Comparative Example E

Example 27 was repeated except omitting 2.0 g of the dispersed resin grains [L-39] to prepare an electrophotographic light-sensitive material.

Comparative Example F

Preparation of Comparative Resin Grains: [LR-2]

A mixed solution of 50 g of acrylic acid, 7.5 g of the dispersion stabilizing resin [AA-2] and 275 g of methyl ethyl ketone was prepared and then subjected to the similar processing to Preparation Example 38 of Resin Grains to prepare resin grain [LR-1] with a polymerization ratio of 100% and an average grain diameter of 0.20 μm.

Preparation of Comparative Photoreceptor

Example 27 was repeated except using 0.8 g (as solid) of the above described resin grains [LR 2] instead of 0.8 g of the resin grains [L-39] to prepare a photoreceptor.

These light-sensitive materials were subjected to estimation of the film property (smoothness of surface), electrostatic properties, oil-desensitivity a photoconductive layer in terms of the contact angle of the photoconductive layer after an oil-desensitizing processing with water and printing performance. The printing performance was examined by subjecting the light-sensitive material to exposing and developing processings using an automatic printing plate making machine ELP 404 V (commercial name, manufactured by Fuji Photo Film Co., Ltd.) and a developing agent ELP-T to form a toner image and then to oil-desensitization. The resulting lithographic printing plate was mounted on an offset printing machine (Hamada Star 800 SX -commercial name-, manufactured by Hamada Star KK) and subjected to printing.

The results are shown in Table 14.

TABLE 14

| | | Example 27 | Comparative Examples E | Comparative Examples F |
|---|---|---|---|---|
| Smoothness of Photoconductive Layer (sec/cc)[1] | | 450 | 460 | 450 |
| Electrostatic Characteristics[2] | | | | |
| $V_{10}$ (−V) | I (20° C., 65% RH) | 555 | 560 | 560 |
| | II (30° C., 80% RH) | 540 | 540 | 540 |
| D.R.R. (%) | I (20° C., 65% RH) | 87 | 87 | 89 |
| | II (30° C., 80% RH) | 85 | 84 | 85 |
| $E_{1/10}$ (lux · sec) | I (20° C., 65% RH) | 13.0 | 13.5 | 13.4 |
| | II (30° C., 80% RH) | 14.5 | 15.0 | 15.0 |
| $E_{1/100}$ (lux · sec) | I (20° C., 65% RH) | 40 | 40 | 40 |
| | II (30° C., 80% RH) | 43 | 45 | 44 |
| Image Quality[3] | I (20° C., 65% RH) | ○ good | ○ good | ○ good |
| | II (30° C., 80% RH) | ○ good | ○ good | ○ good |
| Water Retention[4] | | ⊙ very good | XX remarkable background staining | XX remarkable background staining |
| Background Staining of Print[5] | | no background stain up to 6000 prints | background staining from start | background staining from start |

The characteristic items described in Table 14 were evaluated in an analogous manner to Example 1.

As can be seen from Table 14, the light-sensitive material of the present invention and Comparative Examples A and B showed good electrostatic characteristics and gave reproduced images clear and excellent in image quality.

When each of these light-sensitive materials was subjected to an oil-desensitizing processing to estimate the degree of rendering hydrophilic on non-image areas, background staining by adhesion of a printing ink was remarkable and the non-image areas were not sufficiently rendered hydrophilic in Comparative Examples A and B.

When the sample was subjected to plate making, then to oil-desensitizing processing and to real printing, the lithographic printing plate of the present invention gave 6000 prints of clear image, free from background stains, while in Comparative Examples A and B, background staining on non-image areas was remarkable from the start of printing.

As described above, according to only the present invention, there can be obtained an electrophotographic lithographic printing plate precursor such that the hydrophilic property on non-image areas can sufficiently proceed and background stains do not occur.

Example 28

Example 27 was repeated except using 5.7 g of the binder resin [BR-2] and 32.3 g of the binder resin [BR-3] instead of 38 g of the binder resin [BR-1] to prepare an electrophotographic light-sensitive material:

The various properties were measured in an analogous manner to Example 27. The measured results under severer conditions (30° C., 80% RH) are shown in the following:

| Electrostatic Characteristics | |
|---|---|
| $V_{10}$: | −560 V |
| D.R.R.: | 90% |
| $E_{1/10}$: | 11.3 lux · sec |
| $E_{1/100}$: | 32 lux · sec |
| Image Quality: | very good (◎) |
| Water Retention of Raw Plate: | very good (◎) |
| Background Staining of Print: | no background stains up to 6000 prints |

Each of the light-sensitive materials according to the present invention was excellent in static charge property, dark charge retention and photosensitivity, and a real reproduced image and print gave a clear image without occurrence of background stains even at a high temperature and high humidity (30° C., 80% RH).

Examples 29 to 38

Example 28 was repeated except using 1.0 g (as solid) of resin grains [L] shown in Table 15 of the present invention instead of 0.8 g of the dispersed resin grains in Example 28 to prepare light-sensitive materials.

The electrostatic characteristics and printing property was estimated in an analogous manner to Example 28.

TABLE 15

| Example | Dispersed Resin Grains |
|---|---|
| 29 | [L-45] |
| 30 | [L-46] |
| 31 | [L-47] |
| 32 | [L-48] |
| 33 | [L-49] |
| 34 | [L-50] |
| 35 | [L-51] |
| 36 | [L-52] |
| 37 | [L-53] |
| 38 | [L-54] |

Each of the light-sensitive materials exhibited substantially the similar results in the electrostatic characteristics and image quality to Example 28.

When each of the resulting light-sensitive materials was subjected to oil-desensitizing processing to evaluate the properties of the offset lithographic plate precursor, any material gave a good water retention as a raw plate and printing after plate making gave 6000 prints.

Example 39 and Comparative Examples G and H

A mixture of 6.0 g of a binder resin [BR-9], 34 g of another binder resin [BR-6], 200 g of zinc oxide, 0.018 g of the cyanine dye [A] and 300 g of toluene was ball milled for 4 hours. 1.0 g (as solid) of the resin grains [L-54] was added thereto to prepare a light-sensitive layer forming dispersion and further dispersed for 5 minutes, which was then applied to a paper rendered electrically conductive to give a dry coverage of 25 by a wire bar coater, followed by drying at 100° C. for 3 minutes. The thus coated paper was allowed to stand in a dark place at a temperature of 20° C. and a relative humidity of 65% for 24 hours to prepare an electrophotographic light-sensitive material.

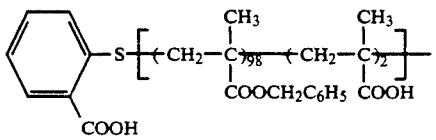

Resin [BR-9]

Comparative Example G

Example 39 was repeated except omitting 1.0 g of the resin grains [L-54] to prepare an electrophotographic light-sensitive material.

Comparative Example H

Example 39 was repeated except using 3 g of the resin grains [LR-2] instead of 1.0 g of the resin grains [L-54] to prepare an electrophotographic light-sensitive material.

These light-sensitive materials were subjected to estimation of the film property (smoothness of surface), film strength, electrostatic characteristics, image quality and electrostatic characteristics and image quality under ambient conditions of 30° C. and 80% RH. Furthermore, when using these light-sensitive materials as an offset master, the oil-desensitivity of the photoconductive layer (water retention) and the printing property (background stains, printing durability) were examined.

The results are shown in Table 16.

TABLE 16

| | | Example 39 | Comparative Examples G | Comparative Examples H |
|---|---|---|---|---|
| Smoothness of Photoconductive Layer (sec/cc) | | 400 | 400 | 450 |
| Electrostatic Characteristics[6)] | | | | |
| $V_{10}$ (−V) | I (20° C., 65% RH) | 630 | 650 | 580 |
| | II (30° C., 80% RH) | 610 | 635 | 560 |
| D.R.R. (%) | I (20° C., 65% RH) | 89 | 90 | 77 |
| | II (30° C., 80% RH) | 86 | 87 | 63 |
| $E_{1/10}$ (lux/sec) | I (20° C., 65% RH) | 20 | 17 | 35 |
| | II (30° C., 80% RH) | 22 | 19 | 43 |
| $E_{1/100}$ (lux/sec) | I (20° C., 65% RH) | 38 | 35 | 90 |
| | II (30° C., 80% RH) | 40 | 38 | 100 |
| Image Quality[3)] | I (20° C., 65% RH) | ○ good | ○ good | Δ~○ $D_M$ tending to lower, slight background stains |
| | II (30° C., 80% RH) | ○ good | ○ good | X occurrence background stains and |

TABLE 16-continued

| | Example 39 | Comparative Examples G | H |
|---|---|---|---|
| | | | disappearance of letters, fine lines |
| Water Retention of Raw Plate | ⊚ very good, no background stains | XX remarkable background staining | ○ no background stains |
| Background Staining of Print | ○ no background stain up too 6000 | XX background staining from start | XX background staining from start disappearance of letters, fine lines |

The characteristic items described in Table 16 were evaluated in an analogous manner to Example 1 as to the smoothness of the photoconductive layer and the background staining of the print, and the other properties were evaluated in an analogous manner to Example 12.

As can be seen from Table 16, the light-sensitive materials of the present invention and Comparative Example G showed excellent electrostatic characteristics and image quality.

In Comparative Example H, on the other hand, the electrostatic characteristics were lowered and largely affected, in particular, when the ambient conditions were fluctuated and in real copied images, there occurred background stains and disappearance of letters and fine lines.

Further, in the precursors having been subjected to an oil-desensitizing processing, only that of the present invention was sufficiently rendered hydrophilic and could give 6000 prints without adhesion of ink, while that of Comparative Example G was not sufficiently rendered hydrophilic and that of Comparative Example H exhibited a sufficient water retention of raw plate, but only gave insufficient prints from the start of printing because of deterioration of a reproduced image in a precursor after really plate making.

Examples 40 to 45

Example 39 was repeated except using respectively 1 g of resin grains [L] shown in Table 17 in place of 2 g of the binder resin grains [L-54], thus obtaining light-sensitive materials.

TABLE 17

| Example | Resin Grains [L] | Electrostatic Characteristics (30° C., 80% RH) $V_{10}$ (−V) | D.R.R. (%) | $E_{1/10}$ (erg/cm$^2$) | $E_{1/100}$ (erg/cm$^2$) | Image Quality (30° C., 80% RH) | Water Retention of Raw Plate |
|---|---|---|---|---|---|---|---|
| 40 | [L-39] | 555 | 85 | 27 | 55 | ⊚ Very Good | ⊚ No Background Stains |
| 41 | [L-41] | 555 | 86 | 26 | 53 | ⊚ Very Good | ⊚ No Background Stains |
| 42 | [L-43] | 550 | 86 | 24 | 54 | ⊚ Very Good | ⊚ No Background Stains |
| 43 | [L-46] | 545 | 85 | 27 | 56 | ⊚ Very Good | ⊚ No Background Stains |
| 44 | [L-48] | 550 | 86 | 28 | 57 | ⊚ Very Good | ⊚ No Background Stains |
| 45 | [L-59] | 555 | 87 | 26 | 55 | ⊚ Very Good | ⊚ No Background Stains |

As shown in Table 17, according to the present invention, there were obtained excellent electrostatic characteristics at not only normal temperature and normal humidity (20° C., 65% RH) but also high temperature and high humidity (30° C., 80% RH). Furthermore, the light-sensitive material of the present invention exhibited good image quality and water retention. When using it as a master plate for offset printing, 6000 or more prints with a clear image quality were obtained without background staining.

Examples 46 to 57

A mixture of 6.0 g of the binder resin [BR-7], 34 g of the binder resin [BR-8], 200 g of photoconductive zinc oxide, 0.20 g of phthalic anhydride, 0.018 g of the cyanine dye [B] and 300 g of toluene was ball milled for 4 hours. 0.9 g (as solid) of resin grains shown in the following Table 18 was then added thereto and further dispersed for 5 minutes, which was then applied to a paper rendered electrically conductive to give a dry coverage of 20 g/m$^2$ by a wire bar coater, followed by drying at 100° C. for 3 minutes. The thus coated paper was allowed to stand in a dark place at a temperature of 20° C. and a relative humidity of 65% for 24 hours to prepare an electrophotographic light-sensitive material.

TABLE 18

| Example | Resin Grains |
|---|---|
| 46 | [L-40] |
| 47 | [L-42] |
| 48 | [L-54] |
| 49 | [L-57] |
| 50 | [L-58] |
| 51 | [L-59] |
| 52 | [L-62] |
| 53 | [L-64] |
| 54 | [L-65] |
| 55 | [L-67] |

TABLE 18-continued

| Example | Resin Grains |
|---|---|
| 56 | [L-69] |
| 57 | [L-72] |

When each of the light-sensitive materials prepared in Examples 46 to 57 was subjected to measurement of the electrostatic characteristics and printing property in an analogous manner to Example 39, all the samples were excellent in electrification property, dark charge retention and photosensitivity and a really reproduced image gave a clear image free from occurrence of background stains and disappearance of fine lines even under severer conditions, e.g., high temperature and high humidity (30° C., 80% RH). When printing was carried out using it as a master plate for offset printing, at least 600 to 8000 sheets of clear images were obtained without occurrence of background stains on non-image areas.

According to the present invention, there can be provided an electrophotographic photoreceptor having excellent electrostatic characteristics and mechanical properties and when using it as a lithographic printing plate precursor, a number of prints with a clear image quality and free from background stains can be obtained. Furthermore, the lithographic printing plate precursor of the present invention is useful for the scanning exposure system using a semiconductor laser beam.

What is claimed is:

1. A electrophotographic lithographic printing plate precursor comprising a conductive support having provided thereon at least one photoconductive layer containing photoconductive zinc oxide and a binder resin, wherein the photoconductive layer contains at least one of the following non-aqueous solvent-dispersed resin grains having an average grain diameter of same as or smaller than the maximum grain diameter of the photoconductive zinc oxide grains, wherein the non-aqueous solvent-dispersed resin grains comprise copolymer resin grains obtained by subjecting to a polymerization reaction in a non-aqueous solvent, a monofunctional monomer (A) being soluble in the non-aqueous solvent but insoluble after polymerization and containing at least one polar group selected from the group consisting of carboxyl group, sulfo group, sulfino group, phosphono group,

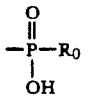

(wherein $R_0$ is a hydrocarbon group or $—OR_{10}$ wherein $R_{10}$ is a hydrocarbon group), hydroxyl group, formyl group, amide group, cyano group, amino group, a cyclic acid anhydride-containing group and a nitrogen atom-containing heterocyclic group, and a monofunctional polymer [M] comprising a polymer principal chain containing at least recurring units each containing a silicon atom and/or fluorine atom-containing substituent, to only one end of which a polymerizable double bond group represented by the following general formula (I) is bonded:

General Formula (I)

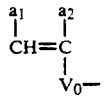

wherein $V_0$ is —O—, —COO—, —OCO—, —$CH_2$OCO—,

—$CH_2$COO—, —$SO_2$—, —CON($R_1$)—, —$SO_2$N($R_1$)—,

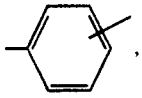

, —CONHCOO— or —CONHCONH—

($R_1$ is a hydrogen atom or a hydrocarbon group containing 1 to 18 carbon atoms), and $a_1$ and $a_2$ are, same or different, hydrogen atoms, halogen atoms, cyano groups, hydrocarbon groups, —COO—$R_2$ or —COO—$R_2$ via a hydrocarbon group ($R_2$ is a hydrogen atom or optionally substituted hydrocarbon group).

2. The electrophotographic lithographic printing plate precursor as claimed in claim 1, wherein the resin grains are present in a proportion of 0.01 to 5% by weight based on 100 parts by weight of the photoconductive zinc oxide.

3. The electrophotographic lithographic printing plate precursor as claimed in claim 1, wherein the monofunctional polymer [M] is soluble in the non-aqueous solvent with a solubility of at least 5% by weight in 100 parts by weight of the solvent at a temperature of 25° C.

4. The electrophotographic lithographic printing plate precursor as claimed in claim 1, wherein the monofunctional polymer [M] has a molecular weight of $1\times10^3$ to $1\times10^5$.

5. The electrophotographic lithographic printing plate precursor as claimed in claim 1, wherein the fluorine atom-containing substituent is $—C_hF_{2h+1}$ (h is an integer of 1 to 12), $—(CF_2)_jCF_2H$ (j is an integer of 1 to 11),

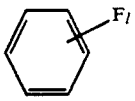

(l is an integer of 1 to 6).

6. The electrophotographic lithographic printing plate precursor as claimed in claim 1, wherein the silicon atom-containing substituent is

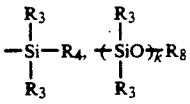

($R_3$ to $R_8$ are, same or different, optionally substituted hydrocarbon and k is an integer of 1 to 20) or a polysiloxane structure.

7. The electrophotographic lithographic printing plate precursor as claimed in claim 1, wherein the solvent dispersed resin grains consist of the monomer (A), the monofunctional polymer [M] and a multifunctional monomer (D).

8. The electrophotographic lithographic printing plate precursor as claimed in claim 1, wherein the monofunctional polymer [M] is present in a proportion of 1 to 50% by weight based on the monomer (A).

9. An electrophotographic lithographic printing plate precursor comprising a conductive support having provided thereon at least one photoconductive layer containing photoconductive zinc oxide and a binder resin, wherein the photoconductive layer contains at least one of the following non-aqueous solvent-dispersed resin grains having an average grain diameter of same as or smaller than the maximum grain diameter of the photoconductive zinc oxide grains, wherein the non-aqueous solvent-dispersed resin grains comprise copolymer resin grains obtained by subjecting to a dispersion polymerization reaction in a non-aqueous solvent in the presence of a dispersion stabilizing resin soluble in the non-aqueous solvent, a monofunctional monomer (A) being soluble in the non-aqueous solvent but insoluble after polymerization and containing at least one polar group selected from the group consisting of carboxyl group, sulfo group, sulfino group, phosphono group,

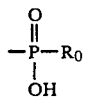

(wherein $R_0$ is a hydrocarbon group or $—OR_{10}$ wherein $R_{10}$ is a hydrocarbon group), hydroxyl group, formyl group, amide group, cyano group, amino group, a cyclic acid anhydride-containing group and a nitrogen atom-containing heterocyclic group, and a monofunctional monomer [B] being copolymerizable with the monofunctional monomer (A) and containing a silicon atom and/or fluorine atom-containing substituent.

10. The electrophotographic lithographic printing plate precursor as claimed in claim 1, wherein the non-aqueous solvent-dispersed resin grains form a cross-linked structure.

11. The electrophotographic lithographic printing plate precursor as claimed in claim 9, wherein the dispersion-stabilizing resin contains at least one polymerizable double bond group moiety represented by the following general formula (II) in the polymer chain:

General Formula (II)

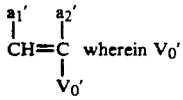

wherein $V_0'$ is —O—, —COO—, —OCO—, $—(CH_2)_p—OCO—$, $—(CH_2)_p—COO—$, $—SO_2—$, -continued

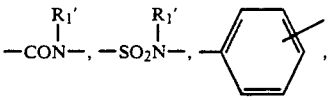

—CONHCOO— or —CONHCONH—

(p is an integer of 1 to 4 and $R_1'$ is a hydrogen atom or a hydrocarbon group containing 1 to 18 carbon atoms), and $a_1'$ and $a_2'$ are, same or different, hydrogen atoms, halogen atoms, cyano groups, hydrocarbon groups, $—COO—R_2'—$ or $—COO—R_2'$ via a hydrocarbon group ($R_2'$ is a hydrogen atom or optionally a substituted hydrocarbon group).

12. The electrophotographic lithographic printing plate precursor as claimed in claim 1, wherein a film is formed by dissolving the resin grains in a suitable solvent and then coating the dissolved resin grains to form said film, wherein said film has a contact angle with distilled water of at most 50 degrees measured by an onigometer.

13. The electrophotographic lithographic printing plate precursor as claimed in claim 1 or 9, wherein the resin grains have a maximum grain diameter of at most 5 μm and an average grain diameter of at most 1 μm.

14. The electrophotographic lithographic printing plate precursor as claimed in claim 9, wherein the resin grains are present in a proportion of 0.01 to 10% by weight based on 100 parts by weight of the photoconductive zinc oxide.

15. The electrophotographic lithographic printing plate precursor as claimed in claim 9, wherein the dispersion stabilizing resin has a weight average molecular weight of $1\times10^3$ to $5\times10^5$.

16. The electrophotographic lithographic printing plate precursor as claimed in claim 9, wherein the dispersion stabilizing resin is at least one member selected from the group consisting of olefin polymers, modified olefin polymers, styrene-olefin copolymers, aliphatic carboxylic acid vinyl ester copolymers, modified maleic anhydride copolymers, polyester polymers, polyether polymers, methacrylate homopolymers, acrylate homopolymers, methacrylate copolymers, arcylate copolymers and alkyd resins.

17. The electrophotographic lithographic printing plate precursor as claimed in claim 9, wherein the solvent dispersed resin grains consists of the monomer (A), the monomer [M] and a multifunctional monomer (D).

18. The electrophotographic lithographic printing plate precursor as claimed in claim 9, wherein the dispersion stabilizing resin is present in a proportion of 1 to 50% by weight of the monomer (A) and monomer (B).

19. The electrophotographic lithographic printing plate precursor as claimed in claim 1 or 9, wherein the photoconductive layer further contains at least one dye as a spectral sensitizer.

* * * * *